US005881339A

United States Patent [19]

Yanagida et al.

[11] Patent Number: 5,881,339

[45] Date of Patent: Mar. 9, 1999

[54] IMAGE FORMING APPARATUS HAVING A CLEANING BLADE FOR REMOVING DEPOSITED TONER

[75] Inventors: Masato Yanagida, Tokyo; Atsuo Tokunaga, Kanagawa, both of Japan

[73] Assignee: Ricoh Company, Ltd., Tokyo, Japan

[21] Appl. No.: 962,733

[22] Filed: Nov. 3, 1997

[30] Foreign Application Priority Data

| | | | |
|---|---|---|---|
| Nov. 1, 1996 | [JP] | Japan | 8-291806 |
| Jun. 20, 1997 | [JP] | Japan | 9-163991 |
| Sep. 18, 1997 | [JP] | Japan | 9-253457 |

[51] Int. Cl.[6] ..... G03G 15/16; G03G 21/00

[52] U.S. Cl. ..... 399/101; 399/43; 399/44; 399/297

[58] Field of Search ..... 399/101, 99, 98, 399/43, 44, 72, 162, 343, 169, 297; 430/125; 347/116

[56] References Cited

U.S. PATENT DOCUMENTS

| | | | |
|---|---|---|---|
| 4,373,800 | 2/1983 | Kamiyama et al. | 399/249 |
| 5,107,285 | 4/1992 | Hamada et al. | 399/169 X |
| 5,175,584 | 12/1992 | Usui | 399/44 |
| 5,386,274 | 1/1995 | Sanpe et al. | 399/101 |
| 5,640,230 | 6/1997 | Ono et al. | 430/125 X |
| 5,648,842 | 7/1997 | Sekine et al. | 430/125 X |

FOREIGN PATENT DOCUMENTS

| | | |
|---|---|---|
| 63-049782 | 3/1988 | Japan . |
| 1-059376 | 3/1989 | Japan . |
| 4-114175 | 4/1992 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In an image forming apparatus of the type including a movable belt and a cleaning blade for cleaning the belt, a toner image in the form of an exclusive line is formed on an image carrier between sheets and then transferred to the belt so as to feed toner to the edge of the cleaning blade. The toner prevents the edge of the cleaning blade from being turned over by the belt. The toner is fed to the cleaning blade in amounts different in the widthwise direction of the belt and can therefore be controlled in amount in the above direction.

46 Claims, 15 Drawing Sheets

IMAGE FORMING APPARATUS HAVING A CLEANING BLADE FOR REMOVING DEPOSITED TONER

BACKGROUND OF THE INVENTION

The present invention relates to a copier, facsimile apparatus, printer or similar electrophotographic image forming apparatus including a movable belt and a cleaning blade for removing toner deposited on the belt. More particularly, the present invention is concerned with an image forming apparatus of the type including an image transfer/sheet transport device having a belt capable of supporting and conveying a sheet or recording medium in order to transfer a toner image from an image carrier to the sheet.

An electrophotographic image forming apparatus includes a photoconductive element. After the photoconductive element has been uniformly charged, it is directly exposed imagewise by an exposing device or is scanned by, e.g., laser optics or an LED (Light Emitting Diode) array in accordance with an image signal. As a result, a latent image is electrostatically formed on the drum. The latent image is developed by toner stored in a developing device to turn out a toner image. The toner image is transferred to a paper sheet, film or similar recording medium either directly or via an intermediate transfer body. The recording medium with the toner image is conveyed to a fixing device in order to fix the toner image thereon.

In an apparatus of the type described, a photoconductive belt or image carrier or an intermediate transfer belt is a typical belt capable of moving with toner deposited thereon. A belt included in an image transfer/sheet transport device for conveying a recording medium in order to transfer a toner image from an image carrier to the medium is another conventional movable belt. Usually, a cleaning blade is used to remove toner undesirably deposited on the surface of any one of such movable belts.

The belt included in the image transfer/sheet transport device is an endless belt formed of rubber or similar elastic material and having a medium resistance. The belt is passed over a drive roller and a driven roller and located to face a photoconductive element or image carrier or an intermediate transfer body. At the time of image transfer, the belt is brought into contact with the image carrier and conveys a recording medium by nipping it in cooperation with the image carrier. A high voltage for image transfer is applied to a bias roller, bias brush or similar bias applying means facing the rear of the belt. As a result, a toner image is transferred from the image carrier to the recording medium. The recording medium with the toner image is separated from the image carrier and then conveyed toward a fixing unit.

Assume that the apparatus including any one of the photoconductive belt, intermediate transfer belt and belt built in the image transfer/sheet transport device is operated to produce a number of copies each having a small image area or accidentally operated to produce a number of white copies. Then, no toner is left on the belt, and therefore no toner exists at the edge of the cleaning blade. In this condition, the coefficient of friction $\mu$ between the belt and the cleaning blade increases, increasing the frictional resistance. It is therefore likely that the edge of the blade is caught and turned over by the surface of the belt. The blade so turned over brings about defective cleaning which would smear the rear of sheets and would cause the toner to fly about, and damages the surface of the belt. This is particularly true with the belt of the image transfer/sheet transport device because only a small amount of toner reaches the blade, compared to the other belts of the kind directly carrying a toner image thereon.

To solve the above problem, when the image carrier is implemented as a belt, a toner image representative of an exclusive line for toner feed may be formed on the image carrier between sheets so as to feed toner to the edge of the cleaning blade assigned to the image carrier. In the case of the belt of the image transfer/sheet transport device, the toner image representative of the exclusive line may be formed on the image carrier between sheets and then transferred to the belt so as to feed toner to the edge of the cleaning blade assigned to the belt. The toner fed to the edge of any one of the cleaning blades prevents the coefficient of friction between the belt and the blade and therefore the frictional resistance from increasing due to the absence of toner. This successfully prevents the edge of the blade from being turned over.

In the case of the belt of the image transfer/sheet transport device, the line for toner feed is formed, e.g., once for a plurality of copies. The line is written over the entire image width of the photoconductive belt or similar image carrier between sheets, and then transferred to the belt. The edge of the blade is prevented from being turned over more positively as the line is formed more frequently. This, however, aggravates toner consumption or brings about excessive toner feed which would result in defective cleaning.

The line for toner feed will be needless if toner contaminating the background of the image carrier is transferred to the belt of the image transfer/sheet transport device and brought to the edge of the associated cleaning blade in a sufficient amount. In practice, however, the amount of toner contaminating the background is noticeably dependent on humidity; it is almost zero at the humidity of 90%. The line is therefore essential, considering the operation of the apparatus in a humid environment. While the contact pressure of the cleaning belt acting on the belt, among others, may be increased in order to ensure the removal of the line, this kind of scheme enhances the cleaning ability to an excessive degree during usual cleaning and causes the blade to deteriorate rapidly.

Some different schemes have been proposed to achieve an improved cleaning ability with a relatively low contact pressure of a cleaning blade in relation to a cleaning device assigned to a photoconductive belt. Japanese Patent Laid-Open Publication No. 60-107686, for example, teaches a cleaning blade held in contact with a photoconductive belt in an inclined position relative to the direction in which the belt runs. Japanese Utility Model Laid-Open Publication Nos. 3-45572 and 3-47574 each discloses a straight cleaning blade held in contact with a cylindrical photoconductive element in an inclined position. With any one of these conventional schemes, it is possible to prevent a great amount of toner from reaching the cleaning blade at the same time and causing defective cleaning to occur. Therefore, any one of such schemes is applicable to a cleaning device assigned to a movable belt in order to remove the toner of the exclusive line under usual cleaning conditions. However, the inclined blade occupies a broader space and must contact the flat portion of the surface of the belt. Should the inclined blade contact, e.g., the curved portion of the belt passed over a roller, the pressure of the blade would not act evenly, i.e., it would sequentially decrease toward the opposite ends of the blade and would thereby bring about defective cleaning.

SUMMARY OF THE INVENTION

It is therefore an object of the present invention to provide an image forming apparatus capable of preventing the edge of a cleaning blade assigned to a movable belt from being turned over due to an increase in frictional resistance, and thereby obviating defecting cleaning and protecting the belt from damage.

It is another object of the present invention to provide an image forming apparatus capable of desirably cleaning a belt with a contact pressure as low as during usual cleaning.

It is still another object of the present invention to provide an image forming apparatus capable of minimizing, under various operating conditions of the apparatus, the wasteful consumption of toner ascribable to an exclusive line for toner feed, and capable of controlling the toner feed in order to prevent the edge of a cleaning blade from being turned over.

It is a further object of the present invention to provide an image forming apparatus distributing the amounts of toner to be fed to a movable belt in a unique manner.

In accordance with the present invention, an image forming apparatus has an endless movable belt, a cleaning blade held in contact with the belt for removing toner deposited on the surface of the belt, and a toner feeding device for feeding toner to the belt in amounts different in the widthwise direction of said belt.

Also, in accordance with the present invention, an image forming apparatus has an image carrier for forming a toner image thereon, an endless movable belt for conveying a recording medium and transferring the toner image from the image carrier to the recording medium, a cleaning blade held in contact with the belt for removing toner deposited on the surface of the belt, and a toner feeding device for feeding toner to the belt in amounts different in the widthwise direction of the belt.

Further, in accordance with the present invention, an image forming apparatus including an image transfer/medium transport device has an image carrier for forming a toner image thereon, a movable belt constituting the image transfer/medium transport device and facing the image carrier, a bias applying member facing the rear of the belt, a cleaning blade for cleaning the front of the belt, a line for toner feed formed on the image carrier between recording media, and a transferring device for transferring the line from the image carrier to the belt. The line feeds toner in amounts different in the widthwise direction of the belt. The belt carrying a recording medium thereon is caused to contact the image carrier in order to transfer the toner image from the image carrier to the belt with a high voltage being applied to the bias applying member, then the recording medium is conveyed toward a fixing section, and then the cleaning blade removes toner left on the front of the belt.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
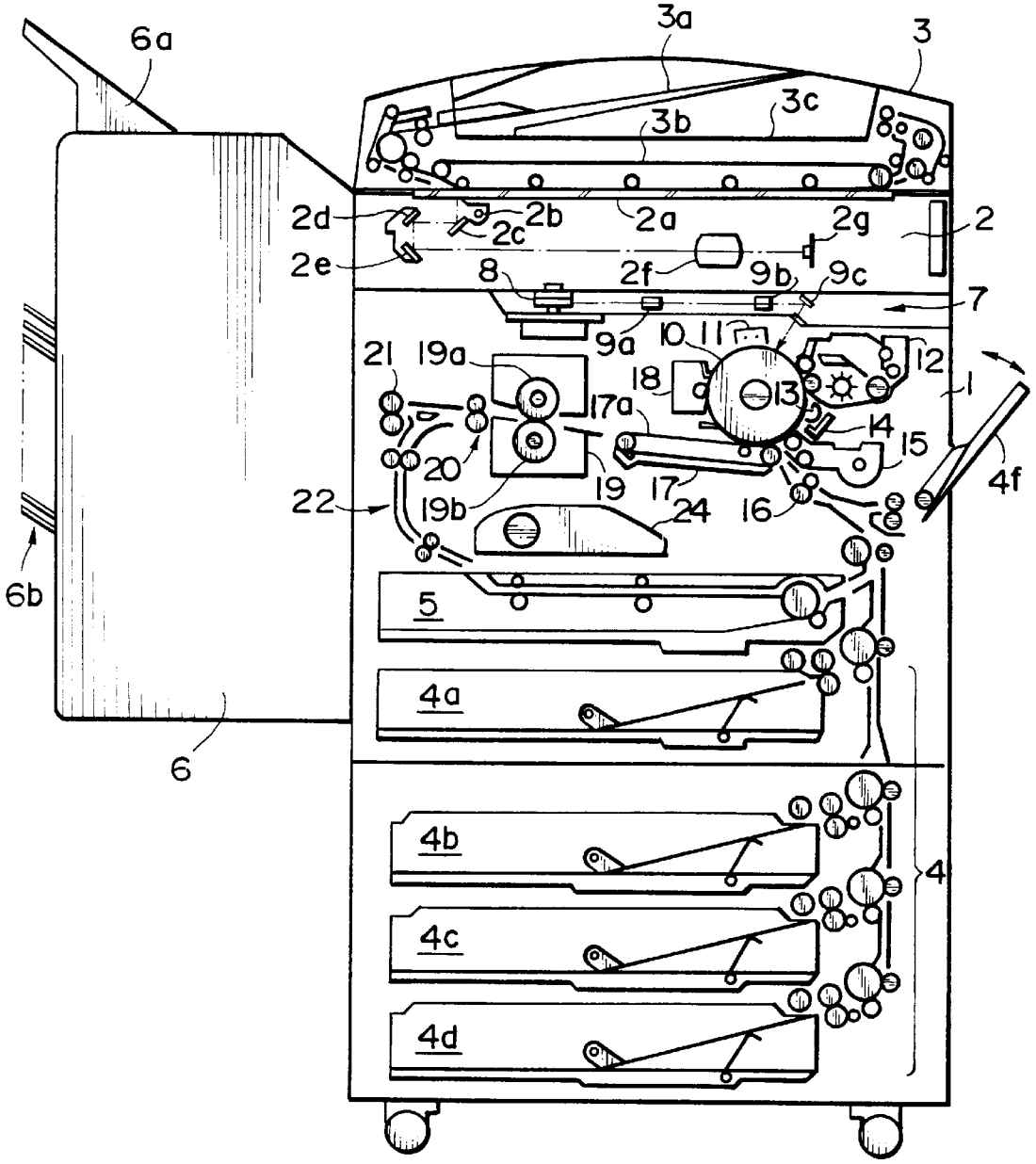
FIG. 1 shows an image forming apparatus embodying the present invention and implemented as a digital copier by way of example.

Referring to FIG. 1 of the drawings, an image forming apparatus embodying the present invention is shown and implemented as a digital copier operable as a printer also. As shown, the copier includes an image forming section (printer hereinafter) 1 for forming images by an electrophotographic process. A document reading section (scanner hereinafter) 2 reads a document image. An ADF (Automatic Document Feeder) 3 automatically feeds documents one by one. A sheet feed section 4 has a plurality of sheet trays 4*a*–4*d* and is capable of feeding sheets of various sizes. A tray 5 is used, in a duplex copy mode, to temporarily stack sheets each carrying an image on one side thereof. A sheet discharging section (sorter hereinafter) 6 receives copies, or printings, sequentially driven out of the copier.

The scanner 2 includes a glass platen 2*a*. The ADF 3 is mounted on the glass platen 2*a* and rotatable about its rear edge toward and away from the glass platen 2*a*. The ADF 3 includes a feed tray 3*a* loaded with a stack of documents, rollers, a belt 3*b*, and a discharge tray 3*c*. While the ADF 3 is held in its closed position, it causes the belt 3*b* to feed the documents one by one to the glass platen 2*a* via the rollers. After each document has been read by the scanner 2, the belt 3*b* drives it out of the ADF 3 onto the discharge tray 3*c*. The ADF 3 may be opened in order to lay a document on the glass platen 2*a* by hand.

The scanner 2 includes a light source 2*b* for illuminating the document laid on the glass platen 2*a*. The resulting imagewise reflection from the document is incident to an image sensor or imaging device 2*g* via optics including mirrors 2*c*, 2*d* and 2*e* and a lens 2*f*. While the light source 2*b* and mirrors 2*c*–2*e* are moved to scan the document, the image sensor 2*g* sequentially transforms the imagewise reflection to a corresponding image signal. The image signal is sent from the image sensor 2*g* to an image processing section, not shown. The illustrative embodiment includes not only a developing unit for black but also a developing unit for red, blue or similar color. The image sensor 2*g* is therefore implemented by, e.g., a color CCD (Charge Coupled Device) image sensor capable of reading a document image while separating its colors. The image processing section converts the outputs of the image sensor 2*g* to color-by-color image signals.

The printer 1 includes an image carrier implemented as a photoconductive drum 10. A first charger 11, a first optical writing device 7, a first developing unit 12, a second charger 13, a second optical writing device 14, a second developing unit 15, a registration roller pair 16, an image transfer/sheet transport device 17 and a cleaning unit 18 are arranged around the drum 10. A fixing unit 19 is located downstream of the device 17 in the direction of sheet transport.

The first charger 11, first optical writing device 7 and first developing unit 12 are assigned to a black image. The writing device 7 has a laser diode 9*a*, a polygonal mirror or similar light deflector 8, an f-θ lens or similar lens 9*b*, and a mirror 9*c*. The laser diode 9*a* emits a laser beam in accordance with a black image signal output from the image processing section. The laser beam forms a latent image representative of a black image on the surface of the drum 10 having been uniformly charged by the charger 11. The developing unit 12 develops the latent image with black toner and thereby produces a black toner image.

The second charger 13, second optical writing device 14 and second developing unit 15 are assigned to a color image, e.g., red image or a blue image. The writing device 14 has an LED array and a lens array. The charger 13 uniformly charges the surface of the drum 10 carrying the black image thereon. The LED array of the writing device 14 emits light in accordance with a red, blue or similar color image signal output from the image processing section. As a result, a latent image representative of a color image is formed on the drum 10 and then developed by color toner stored in the developing unit 15.

A sheet or recording medium is fed from any one of the sheet trays 4*a*–4*d* or from a manual feed tray 4*f* to the registration roller pair 16. The roller pair 16 drives the sheet at such a timing that the leading edge of the sheet meets the leading edge of the black/color toner image formed on the drum 10. Consequently, the black/color toner image is transferred from the drum 10 to the sheet at a nip between the drum 10 and a belt 17*a* included in the image transfer/sheet transport device 17. The sheet carrying the toner image is separated from the drum 10 and conveyed to the fixing unit 19 by the belt 17*a*. A heat roller 19*a* and a press roller 19*b* constituting the fixing unit 19 fix the toner image on the sheet. The sorter 6 has a tray 6*a* and a stack of trays 6*b* arranged below the tray 6*a*. In a simplex copy mode, the sheet with the toner image is driven out to one of the trays 6*a* and 6*b* by roller pairs 20 and 21. In a duplex copy mode, the sheet with the toner image is conveyed to the tray 5 via a duplex copy transport path 22. After the image transfer, the cleaning unit 18 removes the toner left on the drum 10, and then a discharging device, not shown, discharges the surface of the drum 10. The toner collected by the cleaning unit 18 is conveyed to a waste toner tank 24 by a mechanism not shown.

While the illustrative embodiment is applied to a digital copier, the present invention is applicable even to an analog copier or a printer of the type including a movable belt, e.g., a photoconductive belt, intermediate transfer belt or similar image carrier or a belt conveyor for image transfer and sheet transport, and a cleaning blade for removing toner deposited on the movable belt, and directly exposing the image carrier imagewise. Further, the present invention is applicable to a monocolor image forming apparatus including a single optical writing device and a single developing unit, and a full-color image forming apparatus including a plurality of developing units respectively assigned to, e.g., black, cyan, magenta, and yellow.

The image transfer/sheet transport device 17 will be described more specifically with reference to FIG. 2. As shown, the belt 17*a* is implemented as an endless belt having a medium resistance and facing the drum 10. The belt 17*a* is passed over a drive roller 17*b* and a driven roller 17*c*. A bias roller 17*d* faces the rear of the belt 17*a* and is applied with a bias voltage for image transfer. A cleaning unit 23 includes a cleaning blade 17*e* for cleaning the surface of the belt 17*a*. The device 17 additionally includes a moving mechanism for moving the belt 17*a* into and out of contact with the drum 10 and an unlocking mechanism for unlocking the image transfer/sheet transport unit.

Figure 2:
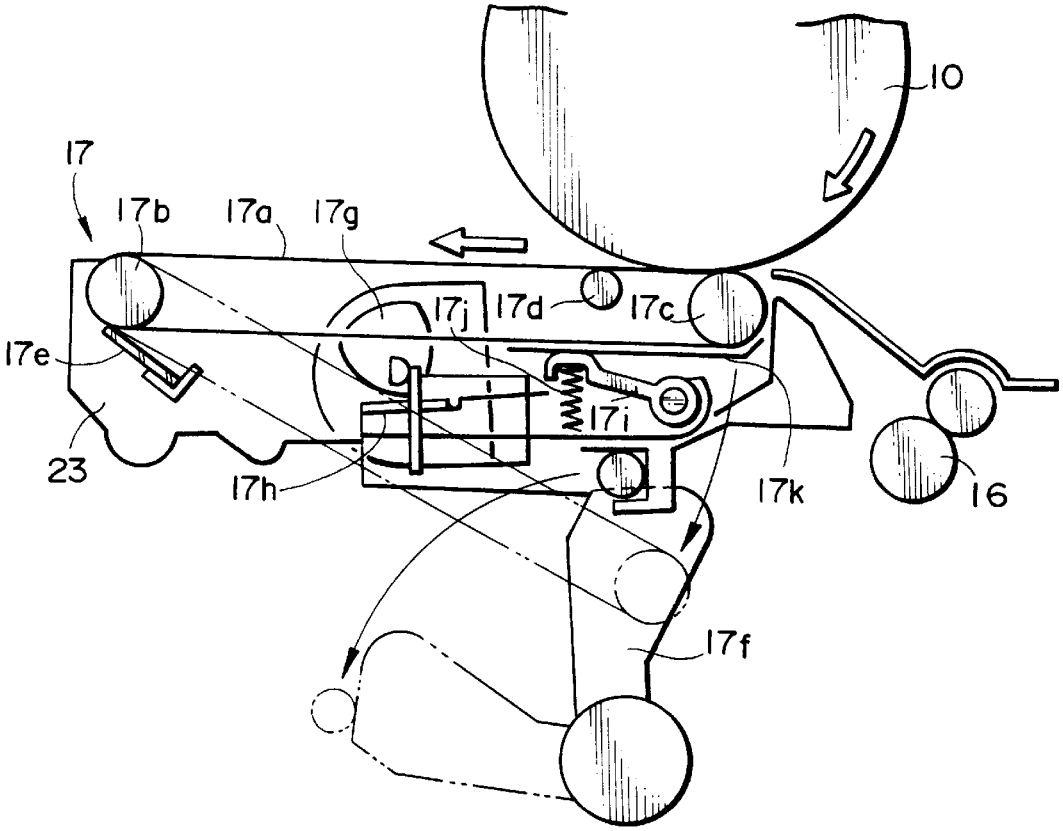
FIG. 2 shows an image transfer/sheet transport device included in the embodiment and having a movable belt.

As shown in FIG. 2, the unlocking mechanism includes an unlock lever 17*f*. When the unlock lever 17*f* is rotated in the direction indicated by an arrow, the image transfer/sheet transport unit is bodily rotated clockwise about the drive roller 17*b* to its unlocked position. The unlocking mechanism promotes easy removal of a jamming sheet and easy mounting and dismounting of the image transfer/sheet transport unit and photoconductive drum unit at the time of maintenance. As also shown in FIG. 2, the moving mechanism includes an electromagnetic spring clutch 17*g* having a cam, a lever 17*h*, an arm 17*i*, and a spring 17*j*. The arm 17*i* is affixed to a shaft on which the lever 17*h* is mounted. The spring 17*j* is positioned between the bottom of the free end of the arm 17*i* and the base portion of the image transfer/sheet transport unit. The top of the free end of the arm 17*i* contacts a support member 17*k* supporting the belt 17*a*.

Figure 3A:
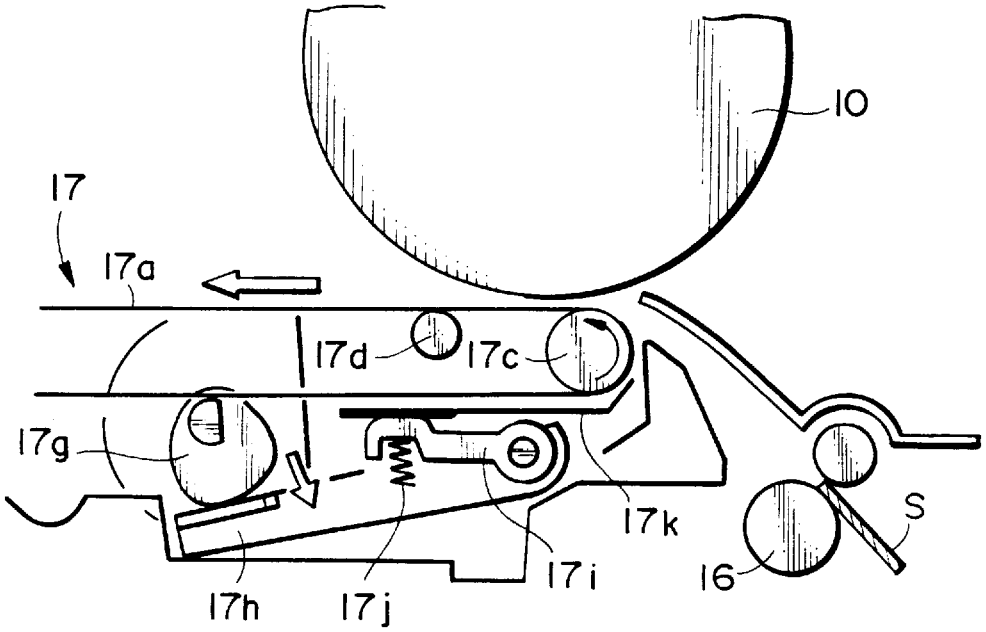
FIGS. 3A and 3B demonstrate the operation of a moving mechanism included in the embodiment for moving the belt of the image transfer/sheet transport mechanism.
Figure 3B:
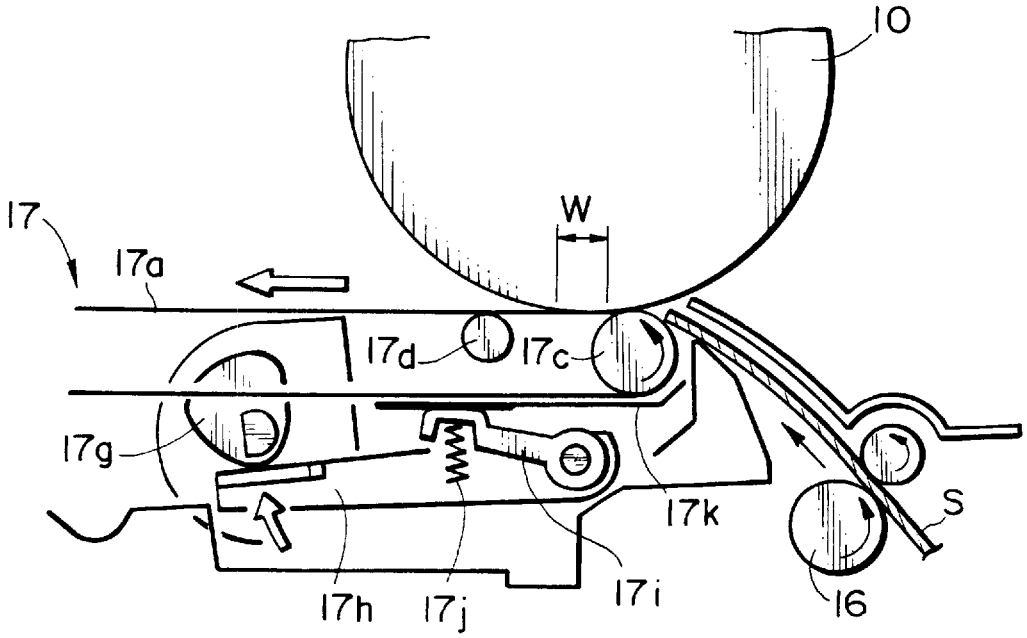

FIG. 3A shows a condition wherein the lever 17*h* is lowered by the cam of the electromagnetic spring clutch 17*g* against the action of the spring 17*j*, i.e., the belt 17*a* is released from the drum 10. The belt 17*a* is held in this position when the copier is out of operation. On the start of an image forming operation, a sheet S fed to the registration roller pair 16 is driven by the roller pair 16 toward the drum 10 at the previously mentioned timing. When the leading edge of the sheet S reaches a position close to the gap between the drum 10 and the belt 17*a*, the clutch 17*g* is energized and causes its cam to make half a rotation. As a result, as shown in FIG. 3B, the lever 17*h* is raised so as to raise the arm 17*i* via the spring 17*j*. The support member 17*k* is therefore raised in order to bring the belt 17*a* into contact with the drum 10, so that a nip W is formed between the drum 10 and the belt 17*a*. The toner image is transferred from the drum 10 to the sheet S at the nip W. After the image transfer, the clutch 17*g* is deenergized to return its cam to the position shown in FIG. 3A. This lowers the lever 17*h* and therefore the arm 17*i* and thereby releases the belt 17*a* from the drum 10.

The mechanism for moving the belt 17*a* in the above-described manner prevents the substances, including oil, of the belt 17*a* from depositing on the drum 10 due to a long time of contact. Further, the mechanical prevents a toner image from being transferred from the drum 10 to the belt 17*a* when its density is sensed by a density sensor usually referred to as a P sensor. Moreover, assume that the image carrier is implemented as a photoconductive drum or an intermediate transfer belt is used, and that an exclusive line to be described later must be input to a cleaning blade assigned to the belt for preventing the blade from being turned over. Then, the moving mechanical effectively releases the belt from the image carrier.

Figure 4:
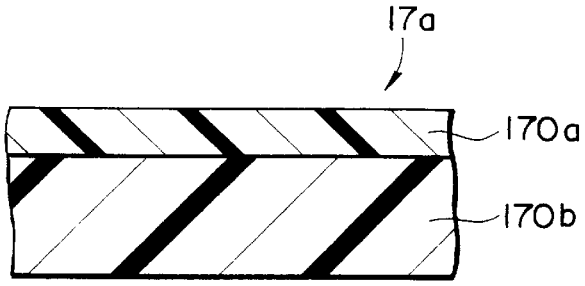
FIG. 4 is a fragmentary section showing the belt.

The endless belt 17*a* having a medium resistance has a double layer structure, as shown in FIG. 4. A top layer or surface layer 170*a* has a surface resistivity of $1\times10^{9}$ Ω to $1\times10^{12}$ Ω while a bottom layer 170*b* underlying the top layer 170*a* has a surface resistivity of $1\times10^{7}$ Ω to $1\times10^{9}$ Ω. The entire belt 17*a* has a volume resistivity of $5\times10^{8}$ Ω.cm to $5\times10^{10}$ Ωcm. These resistivities were measured by a method prescribed by JIS (Japanese Industrial Standards) K6911 and when a DC voltage of 100 V was applied.

Figure 5A:
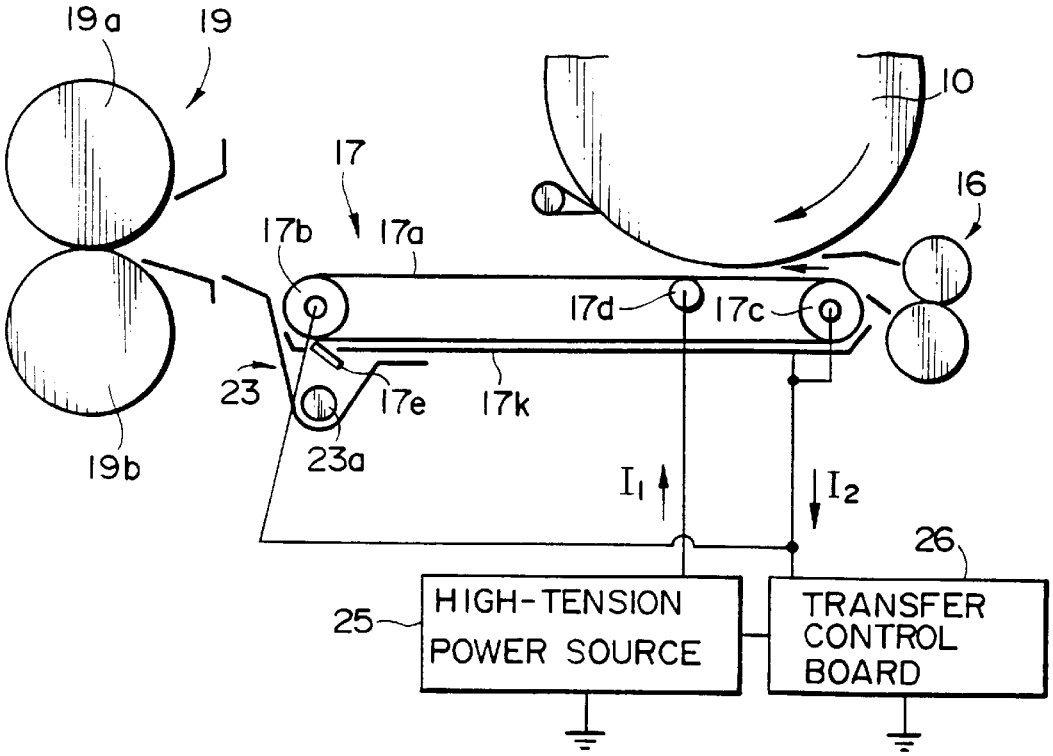
FIGS. 5A and 5B show the construction and operation of the image transfer/sheet transport device together with an electric arrangement.
Figure 5B:
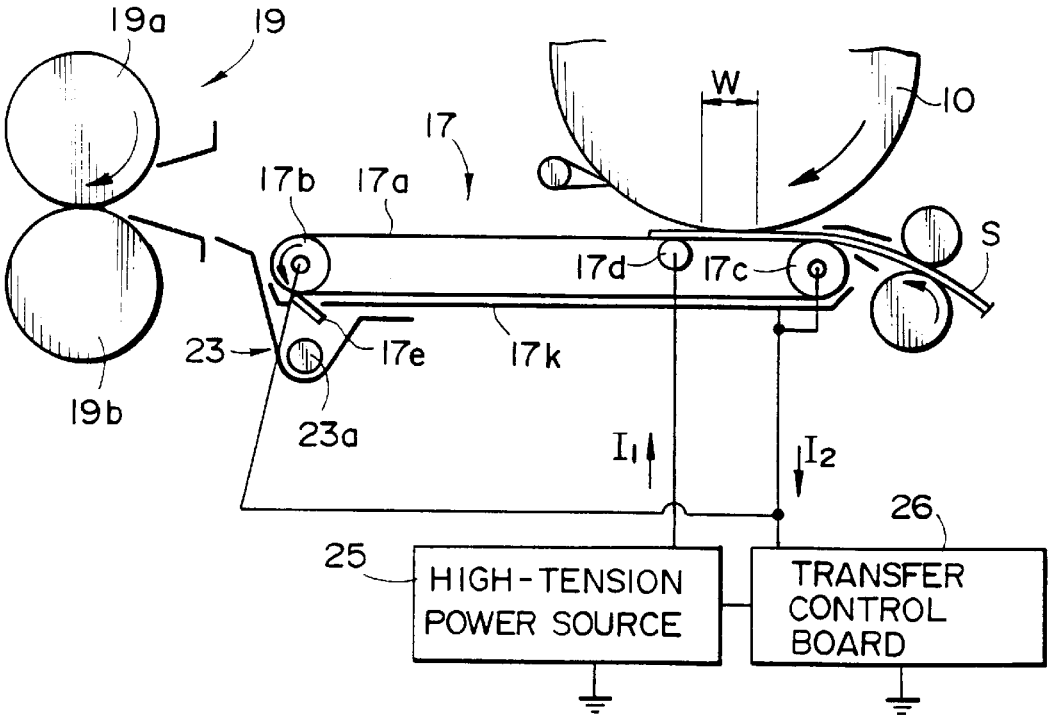

As shown in FIGS. 5A and 5B, the bias roller 17*d* to which a bias voltage for image transfer is applied is located downstream of the driven roller 17*c* in the direction of movement of the belt 17*a* and held in contact with the rear of the belt 17*a*. The bias roller 17*d* is connected to a high-tension power source 25 and constitutes a contact electrode for applying a charge opposite in polarity to the toner deposited on the drum 10 to the belt 17*a*. The bias roller 17*d* may be replaced with a brush or a blade, if desired.

The drive roller 17*b* and driven roller 17*c* cooperate to sense a current flowing through the belt 17*a* as a feedback current. A current to be fed from the bias roller 17*d* is controlled on the basis of the sensed current. For this purpose, an image transfer control board 26 is connected to the rollers 17*b* and 17*c* so as to feed a current based on the sensed current to the bias roller 17*d*. The board 26 is connected to the power source 25.

Figure 6:
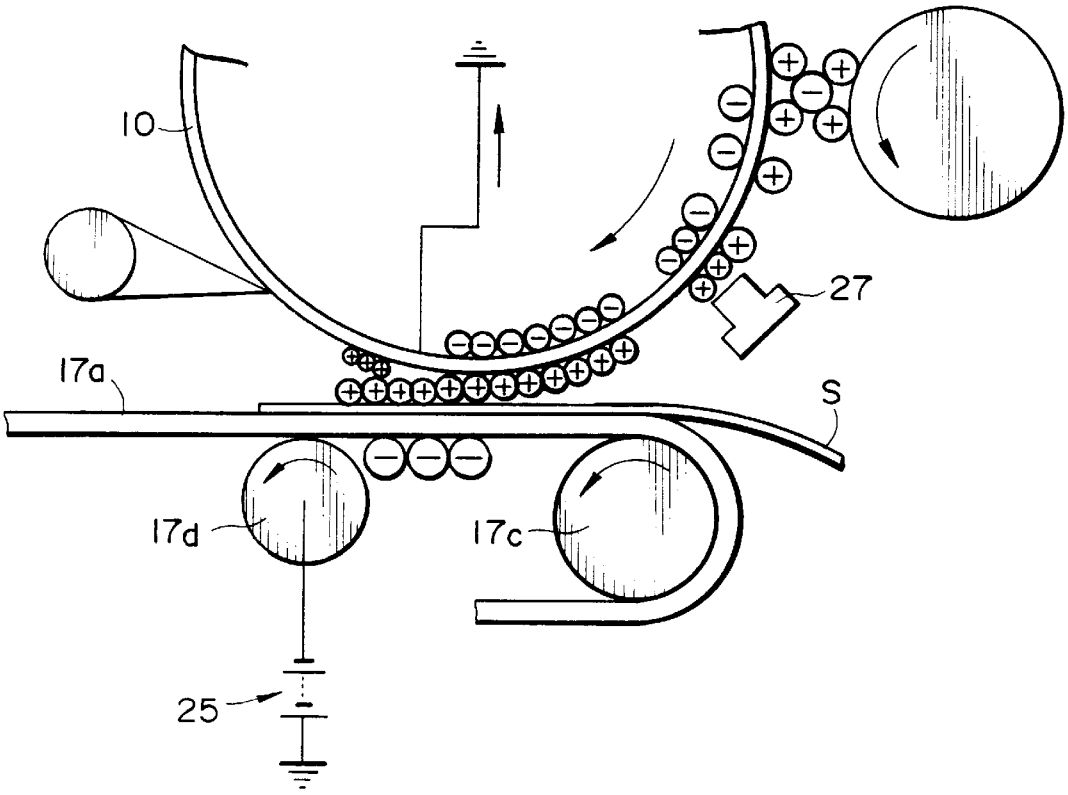
FIG. 6 demonstrates how a toner image is transferred by the image transfer/sheet transport device shown in FIGS. 5A and 5B.

When the sheet S is driven by the registration roller pair 16, the image transfer/sheet transport device 17 has its belt 17*a* brought into contact with the drum 10 by the moving mechanism (FIGS. 2, 3A and 3B) via the support member 17*k*. As a result, the belt 17*a* is displaced from the position shown in FIG. 5A to the position shown in FIG. 5B. In this condition, the belt 17*a* and drum 10 form the previously mentioned nip W broad enough to convey the sheet S, e.g., about 12 mm. On the other hand, the drum 10 has its surface charged to, e.g., −800 V. As shown in FIG. 6 specifically, the surface of the drum 10 moves to the nip W while electrostatically retaining toner of positive polarity thereon.

As shown in FIG. 6, the toner is transferred from the drum 10 to the sheet S at the nip W shown in FIG. 5B due to the bias applied from the power source 25 to the bias roller 17*d*. The bias is variably controlled within the range of from −1.5 kV to −6.5 kV by the following constant current control. As shown in FIGS. 5A and 5B, assume that the output current of the power source 25 is $I_1$, and that a current or feedback current flowing to ground via the belt 17*a* and rollers 17*b* and 17*c* is $I_2$. Then, the current $I_1$ is so controlled as to set up the following relation:

$$I_1-I_2=I_{OUT}$$

where $I_{OUT}$ constant. With this relation, it is possible to stabilize the surface potential $V_P$ of the sheet S and thereby maintain the image transfer efficiency constant without regard to the varying temperature and humidity or irregularity in the quality of the belt 17*a*. In FIG. 6, there is an eraser 27 capable of erasing a latent image when the latent image is not needed.

More specifically, assuming that the current $I_{OUT}$ flows to the drum 10 via the belt 17*a* and sheet S, there can be obviated an occurrence that variation in the easiness of flow of a current to the belt 17*a* and ascribable to a decrease or an increase in the surface resistance of the sheet S effects the separating ability of the sheet S and image transfer.

Experiments showed that desirable image transfer is achievable with a current $I_{OUT}$ of −35 μA±5 μA when a conveying speed is 330 mm/sec and the bias roller 17*d* has an effective length of 310 mm.

When the toner image is transferred from the drum 10 to the sheet S, the sheet S is also charged. The sheet S is therefore electrostatically attracted by the belt 17*a* due to a relation between the true charge of the belt 17*a* and the polarization charge of the sheet S. As a result, the sheet S is successfully separated from the drum 10. In addition, the elasticity of the sheet S is combined with the curvature of the drum 10 to further promote the separation of the sheet S from the drum 10. However, when humidity is high, a current easily flows to the sheet S and obstructs the separation of the sheet S.

In light of the above, the surface layer 170*a* of the belt 17*a* shown in FIG. 4 is provided with a relatively high resistance. Such a resistance successfully delays the transfer of the true charge to the sheet S at the nip W. This, coupled with the fact that the bias roller 17*d* is located downstream of the nip W in the direction of sheet transport, delays the transfer of the true charge from the belt 17*a* to the sheet S and thereby obviates electric attraction between the sheet S and the drum 10. To delay the transfer of the true charge means to prevent the sheet S from being charged before it reaches the nip W. This prevents the sheet S from wrapping around the drum 10 and frees the sheet S from defective separation.

Further, the belt 17*a* should preferably be formed of a material whose resistance is scarcely susceptible to environment. To control the resistance, carbon, zinc oxide or similar conductive material is added in an adequate amount. When the belt 17*a* is implemented as a rubber belt, it is preferable to use chloroprene rubber, EPDM rubber, silicone rubber, epichlorohydrin rubber or similar rubber low in hydroscopic property and stable in resistance.

It is to be noted that the current $I_{OUT}$ to flow to the drum 10 is not unconditional, but may be reduced when the conveying speed is low or increased when it is high.

The sheet S moved away from the nip W is conveyed by the belt 17*a* while being electrostatically retained thereby, and then separated from the belt 17*a* due to the curvature of the drive roller 17*b*. For this purpose, the diameter of the drive roller 17*b* is selected to be less than 18 mm inclusive. With such a drive roller 17*b*, it is possible to separate even fine paper 45K (rigidity: 21 ($cm^3$/100) horizontal), as determined by experiments.

The sheet S separated from the belt 17*a* by the drive roller 17*b* is conveyed to between the heat roller 19*a* and press roller 19*b* of the fixing unit 19 along a guide plate. The two rollers 19*a* and 19*b* cooperate to fix the toner on the sheet S by applying heat and pressure thereto.

After the image transfer and sheet separation, the support member 17*k* shown in FIGS. 2, 3A and 3B is lowered by the moving mechanism so as to release the belt 17*a* from the drum 10. Then, the cleaning unit 23 cleans the surface of the belt 17*a*. Specifically, the cleaning blade 17*e* scrapes off the toner transferred from the drum 10 to the belt 17*a*, toner flown around the belt 17*a* without being transferred to the sheet S, and paper dust.

The belt 17*a* has its surface or front covered with a fluorine-contained resin having a small coefficient of friction, e.g., vinylidene polyfluoride or ethylene tetrafluoride. This prevents the required torque from increasing due to an increase in frictional resistance and prevents the edge of the cleaning blade 17*a* from being turned over. A screw 23*a* conveys the toner and paper dust collected from the belt 17*a* to the waste toner tank 24 shown in FIG. 1.

Assume that the apparatus including the image transfer/sheet transport device 17 having the above basic configuration is operated to produce a number of copies each having a small image area or accidentally operated to produce a number of white copies. Then, no toner is left on the belt 17*a*, and therefore no toner exists at the edge of the cleaning blade 17*e*. In this condition, the coefficient of friction $\mu$ between the belt 17*a* and the cleaning blade 17*e* increases, increasing the frictional resistance. It is therefore likely that the edge of the blade 17*e* is caught and turned over by the surface of the belt 17*a*. The belt 17*a* so turned over brings about defective cleaning which would smear the rear of sheets and would cause the toner to fly about, and damages the surface of the belt 17*a*.

To prevent the belt 17*a* from being turned over, the illustrative embodiment additionally includes means for feeding toner to the belt 17*a*, as follows. An exclusive line for toner feed is formed on the drum 10 between sheets and then transferred to the belt 17*a*. Specifically, the line formed on the drum 10 between sheets is transferred to the belt 17*a* and then fed to the edge of the cleaning blade 17*e*. This prevents the coefficient of friction between the belt 17*a* and the blade 17*e* from increasing due to the absence of toner, and thereby prevents the blade 17*e* from being turned over by the belt 17*a*. Specific configurations of the above exclusive line will be described with reference to FIGS. 7–12.

Figure 7:
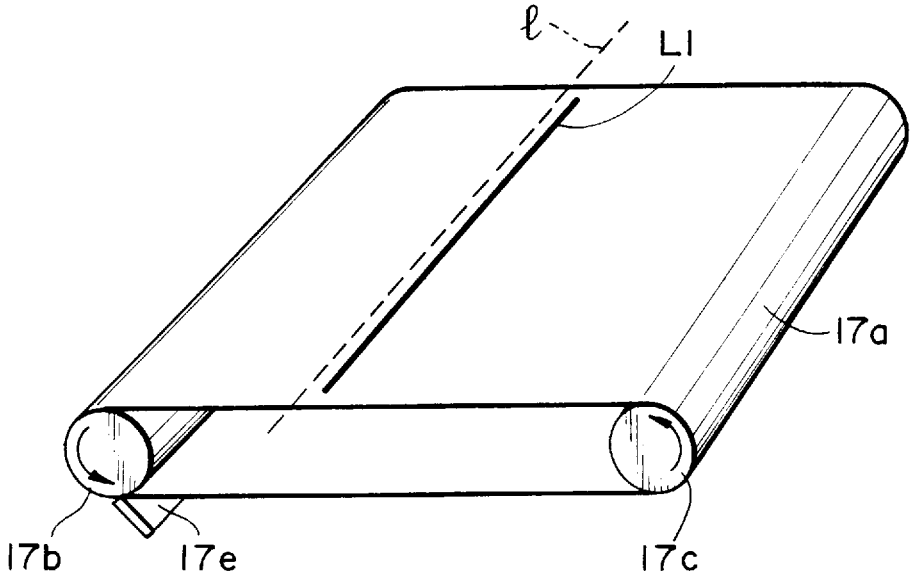
FIGS. 7–12 each shows a specific pattern representative of an exclusive line for toner feed particular to the embodiment.
Figure 8:
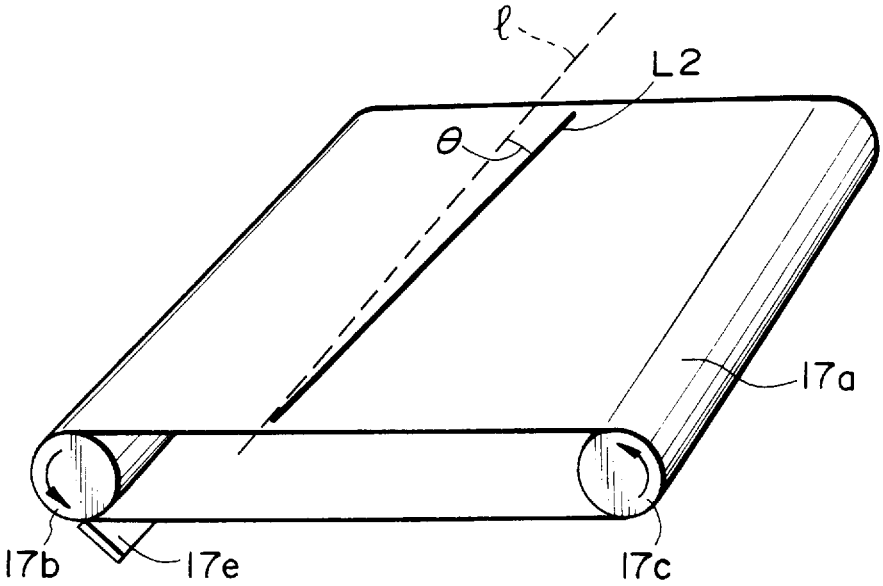
Figure 9:
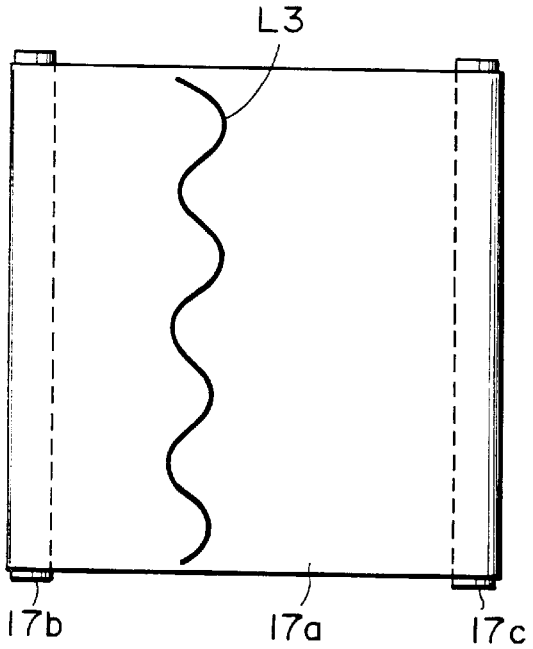
Figure 10:
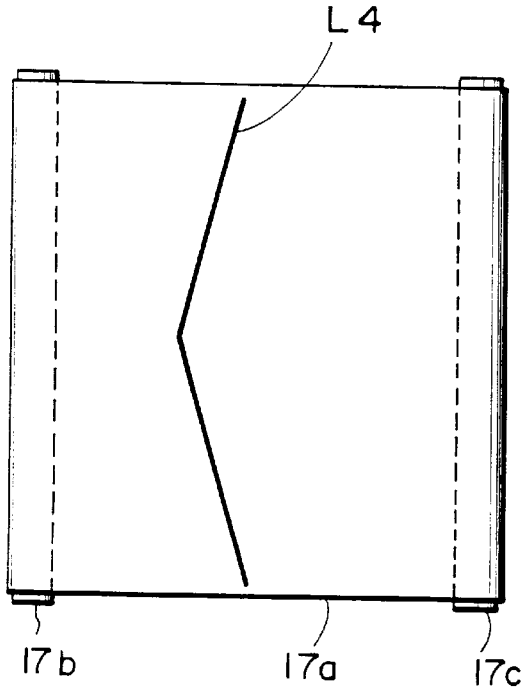

FIG. 7 shows a line L1 having a width of about 2 mm and formed on the drum 10 between sheets once for a plurality of copies. The line L1 is parallel to a line l on which the cleaning blade 17*e* contacts the belt 17*a*. FIG. 8 shows a line L2 inclined by an angle of θ relative to the above contact line l. The line L1 or L2 extends over the entire image width and is transferred to the belt 17*a*. FIGS. 9 and 10 respectively show a wave line L3 and a bent line L4 which are not straight.

The prerequisite with the inclined line l shown in FIG. 8 is that the angle θ be as great as possible within the range not effecting the copying speed, i.e., CPM (Copies Per Minute); otherwise, the interval between consecutive sheets would increase and thereby reduce CPM. This is also true with the lines L3 and L4 shown in FIGS. 9 and 10, respectively.

Figure 11A:
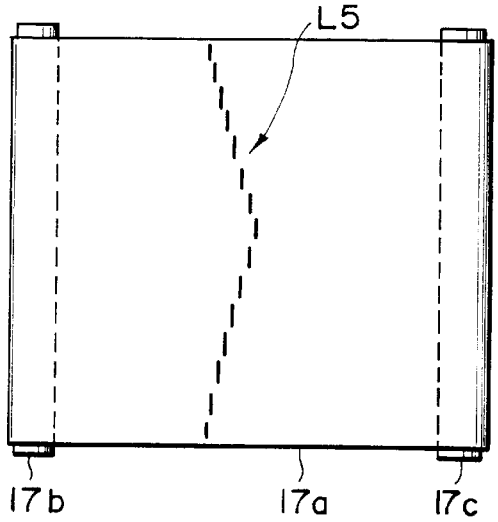
Figure 11B:
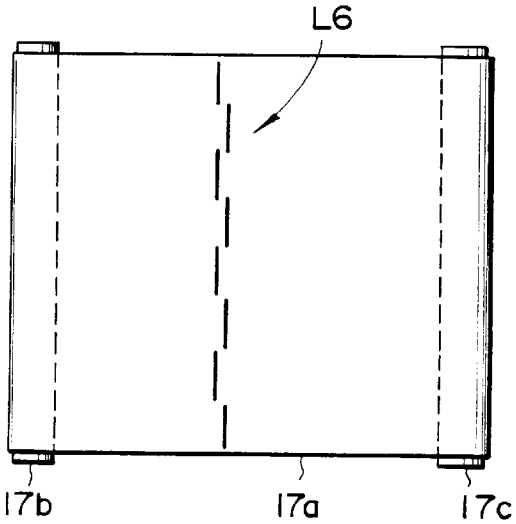
Figure 11C:
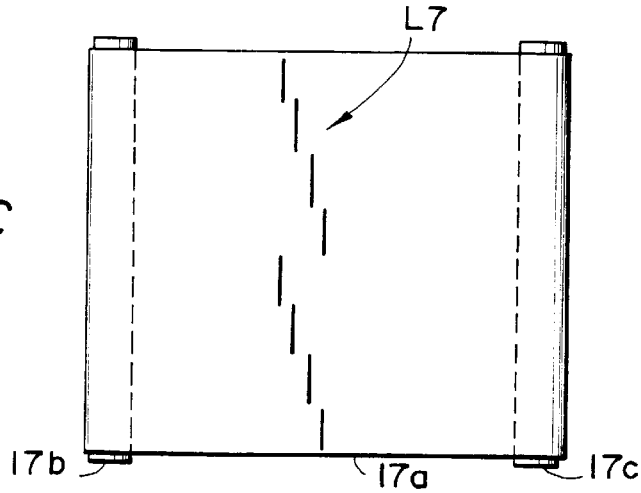
Figure 12:
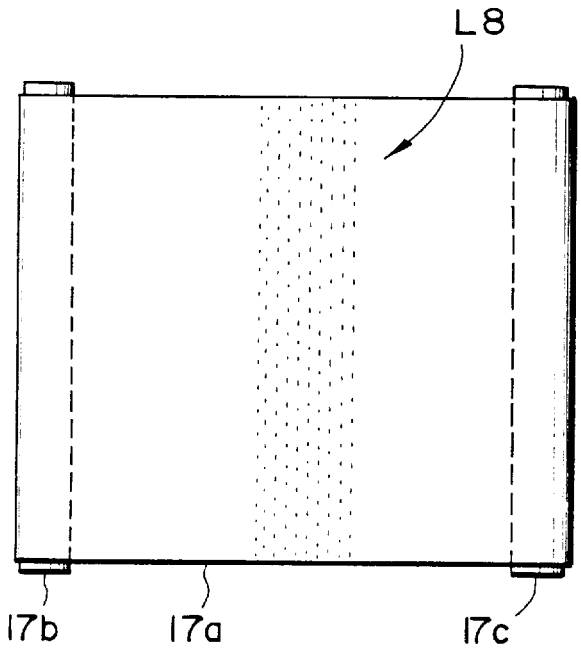

FIGS. 11A–11C respectively show lines L5, L6 and L7 each consisting of a plurality of short straight segments. The line L5 has segments arranged in the form of a bent line. The line L6 has segments arranged in a zigzag configuration. The line L7 has segments arranged in the form of two lines inclined relative to the contact line of the cleaning blade 17*e*. The lines L5–L7 each prevents toner from reaching the entire width of the blade 17*e* at the same time and thereby allows the blade 17*e* to clean the belt 17*a* extremely easily. As a result, the contact pressure of the blade 17*e* is lowered. That is, even if the contact pressure of the blade 17*e* is as low as during usual cleaning, the blade 17*e* can desirably remove the toner from the belt 17*a*. This frees the blade 17*e* from deterioration ascribable to the line. FIG. 12 shows a line L8 in the form of a barely visible stripe as thin as background contamination.

The prerequisite with the lines L5, L6 and L7 shown in FIGS. 11A, 11B and 11C is that the distance between nearby segments in the direction of movement of the belt 17*a* be as great as possible within the range not effecting CPM; otherwise, the interval between consecutive sheets would increase and thereby reduce CPM.

Figure 13:
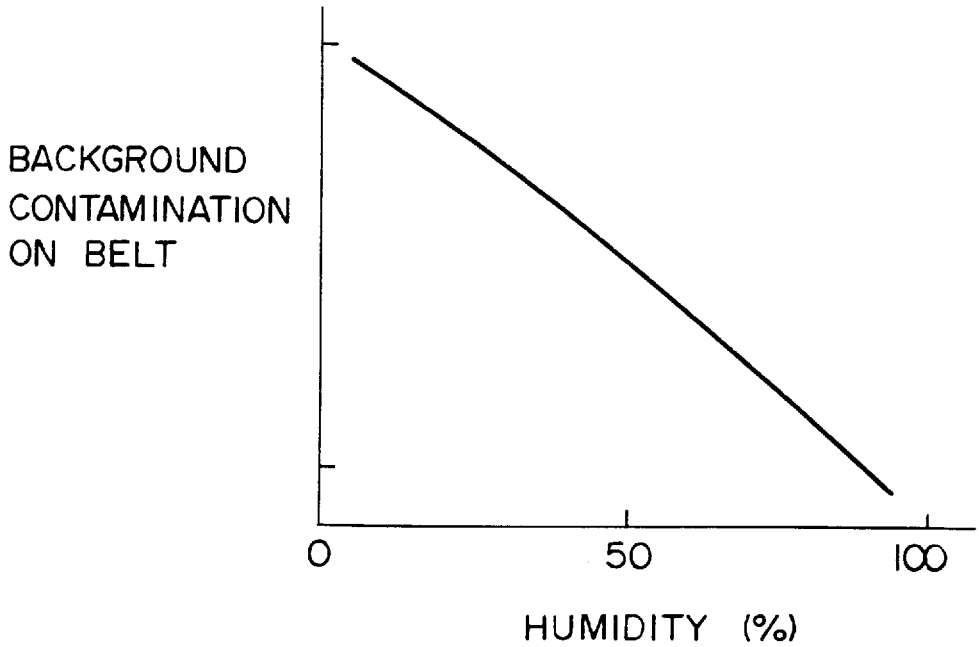
FIG. 13 is a graph showing a relation between background contamination on the belt of the image transfer/sheet transport device and humidity.

The lines L1–L8 each is formed between sheets once for a predetermined number of copies. Therefore, the edge of the cleaning blade 17*e* will be prevented from being turned over more positively if the line is formed more frequently. However, the frequent formation of the line results in the waste of toner and defective cleaning. Such a line will be needless if much toner contaminating the background is deposited on the belt 17*a* and brought to the edge of the blade 17*e*. However, as shown in FIG. 13, the amount of toner contaminating the background and deposited on the belt 17*a* noticeably depends on humidity. At the humidity of 90%, for example, such a kind of toner deposited on the belt 17*a* is almost zero. It follows that the line should be formed at relatively short intervals in a high humidity environment.

In the illustrative embodiment, the above intervals are determined in accordance with the conditions in which the apparatus is use. In various conditions in which the apparatus is operated (e.g. temperature, humidity and presence/absence of air conditioning), control is so executed as to minimize the wasteful consumption of toner by the lines and to prevent the cleaning blade 17*e* from being turned over. Specifically, when the copier or similar image forming apparatus is used in a summer environment (high temperature and high humidity), the amount of toner contaminating the background and deposited on the belt 17*a* is small, as shown in FIG. 13. In such an environment, the line is formed once for fifteen copies by way of example. In an ordinary office environment (with air conditioning), an adequate amount of toner contaminates the background and deposits on the belt 17*a*, so that the line may be formed once for thirty copies. On the other hand, in a winter environment (low temperature and low humidity), the line does not have to be formed at all because much toner deposits on the belt, as shown in FIG. 13.

It is to be noted that the number of copies for which the line should be formed once is input in the apparatus by a serviceman via, e.g., keys arranged on the operation panel of the apparatus.

Figure 14:
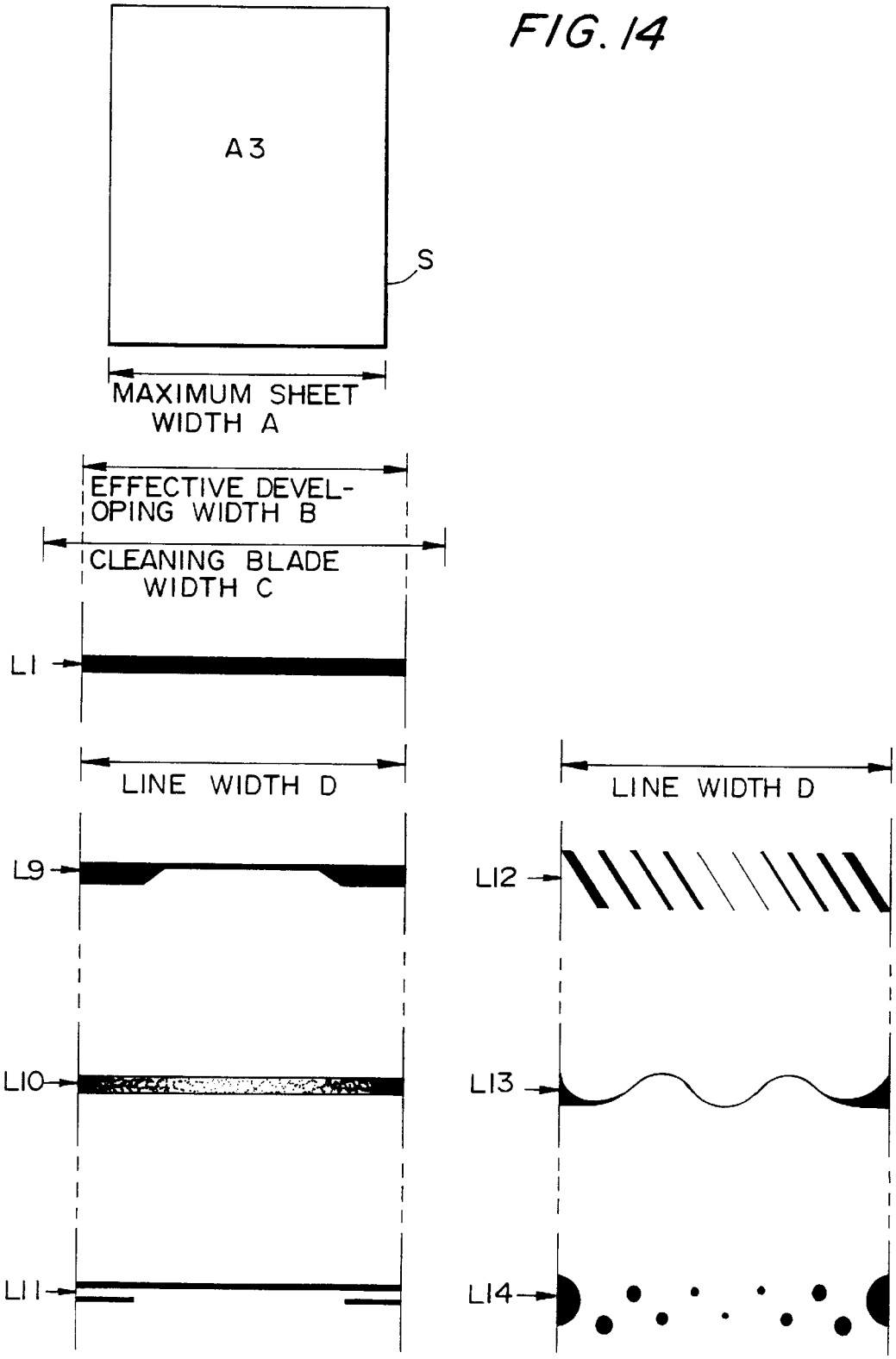
FIG. 14 compares the width of the line and the width of a cleaning blade and shows other specific patterns representative of the line.

As shown in FIG. 14, an effective developing width B (over which toner contaminating the background deposits) is greater than the maximum width A of the sheet S (maximum image width). The cleaning blade 17*e* has a width C even greater than the effective developing width B in order to remove toner deposited over the entire width B. The line L1 has a width D, as measured in the widthwise direction of the belt 17*a*, selected to be greater than the maximum sheet width A, but smaller than the width C of the blade 17*e*; the width D is substantially the same as the developing width B. Why the width D is selected to be smaller than the width C is that toner input over the entire width of the blade 17*e* would fly about and would bring about defective cleaning. Basically, therefore, the input toner is absent at the outside of the effective developing width B, but it spreads to the width C of the blade 17*e* along the edge of the blade 17*e*. However, if the amount of toner in the developing width B is short, it fails to sufficiently spread to the width C of the blade 17*e*. This increases the coefficient of friction $\mu$ at the opposite end portions of the blade 17*e* and is likely to cause the edge of the blade 17*e* to be turned over (the edge 17*e* is often turned over at its end portions). When a greater amount of toner is input to the blade 17*e* in the developing width B in order to prevent it from being turned over, an excessive amount of toner gathers at the intermediate portion of the blade 17*e*, resulting in wasteful toner consumption and defective cleaning.

In light of the above, the illustrative embodiment sets up a unique toner distribution in the widthwise direction of the belt 17*a*, as follows. A greater amount of toner is fed to the opposite end portions of the belt 17*a* than to the intermediate portion of the same. This allows the toner for the cleaning blade 17*e* to be controlled in the widthwise direction of the belt 17*a*, thereby obviating wasteful toner consumption and preventing the belt 17*a* from being turned over at its opposite end portions.

Some specific methods for controlling the amount of toner as stated above will be described with reference to FIG. 14. As shown, a line L9 is thinner at its intermediate portion than its opposite end portions. A line L10 is lower in density at its intermediate portion than its opposite end portions. A line L11 has its number increased at its opposite end portions. With any one of these lines L9–L11, it is possible to distribute the toner in a particular amount in each of the intermediate portion and opposite end portions of the belt 17*a*.

Lines L12, L13 and L14 also shown in FIG. 14 give consideration to both of the control over the toner distribution and the cleaning ability. The line 12 is implemented by a plurality of slashes arranged in the widthwise direction of the belt 17*a* and sequentially increasing in thickness (amount of toner) toward the opposite ends. Because the slashes of the line L12 are spaced from each other, the toner is not input over the entire width of the cleaning blade 17*e* at the same time and allows the cleaning ability to be enhanced. The line L13 is in the form of a wave having a greater amount of toner at its opposite end portions than at its intermediate portion. Further, the line L14 is implemented by a plurality of circular dots sequentially increasing in area or density toward the opposite ends of the line L14. Although the dots of the line L14 are spaced from each other, the toner is fed even between the dots because the toner spreads in opposite directions at the edge of the blade 17*e*.

Figure 15:
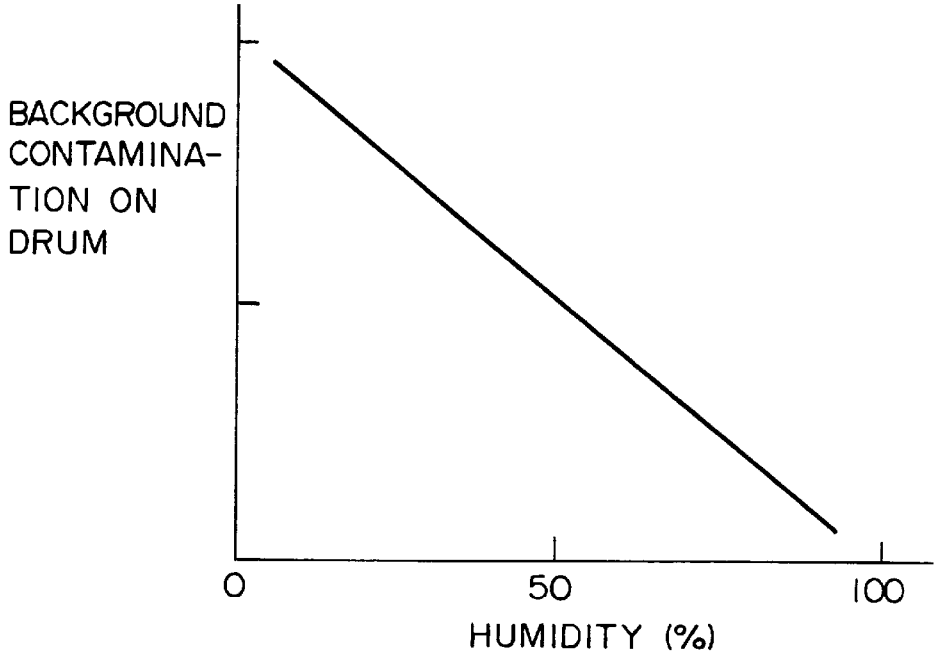
FIG. 15 is a graph showing a relation between humidity around a photoconductive drum and the amount of background contamination on a photoconductive drum.

FIG. 15 shows a relation between humidity around the drum 10 and background contamination on the drum 10 and resembling the relation shown in FIG. 13. As shown, toner contaminating the background of the drum 10 is transferred to the belt 17*a* with a certain probability and conveyed to the cleaning blade 17*e*. However, the background contamination decreases with an increase in humidity. Therefore, when humidity is high, the amount of toner to reach the blade 17*e* noticeably decreases and causes the edge of the blade 17*e* to be easily turned over.

Considering the relation shown in FIG. 15, the illustrative embodiment controls the amount of toner feed on the basis of humidity around the drum 10. Specifically, while the line for toner feed is usually formed once for thirty copies, the line is formed once for twenty copies when humidity rises above 60% or once for forty copies when humidity falls below 30%. In this manner, a decrease in background contamination ascribable to humidity is compensated for by an increase in the amount of toner fed by the line. This prevents the cleaning blade 17*e* from being turned over without wasting much toner.

Figure 16:
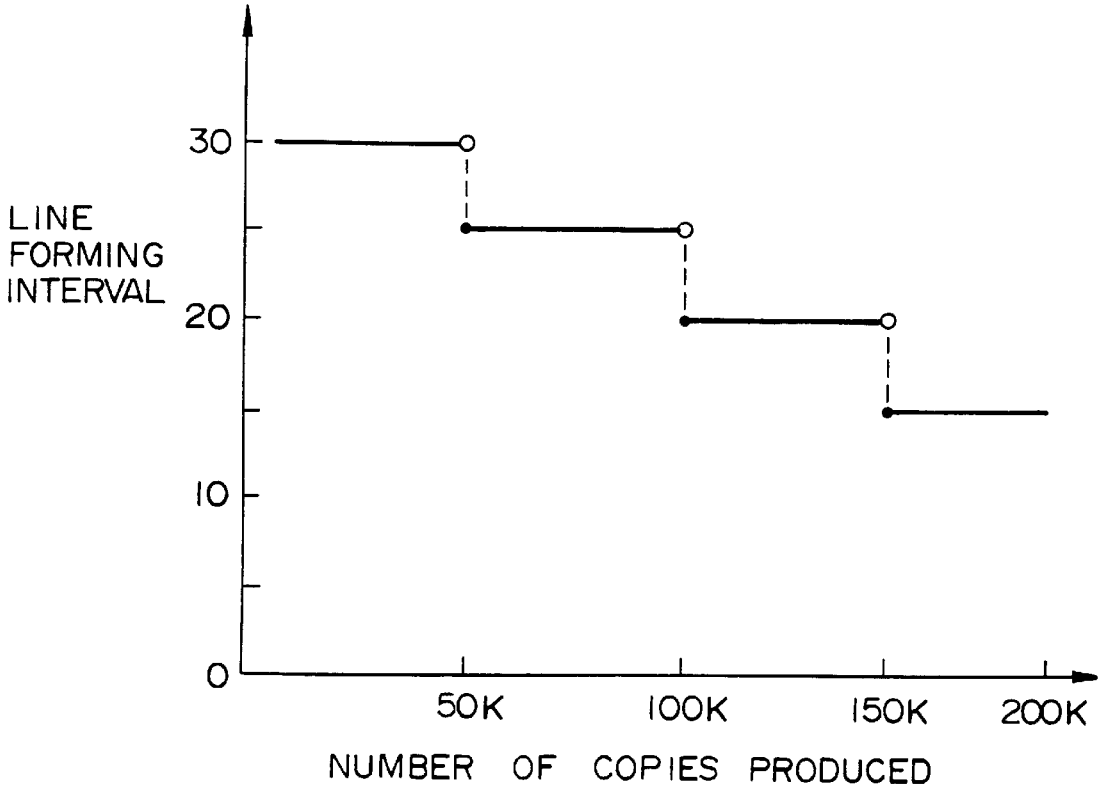
FIG. 16 is a graph showing a relation between the number of copies produced and the interval between the lines sequentially formed.

Generally, an image transfer belt or similar movable belt tends to increase its coefficient of friction $\mu$ due to cracks and filming as the number of copies produced (images) increases. The illustrative embodiment controls the amount of toner feed using the line in accordance with the number of copies produced. Specifically, as shown in FIG. 16, the interval between the lines sequentially formed is varied stepwise in accordance with the number of copies produced. For example, the line is formed once for thirty copies up to 50,000 copies, once for twenty-five copies up to 100,000 copies, once for twenty copies up to 150,000 copies, and once for fifteen copies up to 200,000 copies. Also, the amount of toner to be input to the cleaning blade 17*e* is increased stepwise with an increase in the number of copies produced by using any one of the specific line configurations stated earlier. When the belt 17*a* is replaced, the interval between the lines is reset to its initial value. In this manner, the amount of toner to be fed to the blade 17*e* is controlled on the basis of the number of copies produced. This prevents the blade 17*e* from being turned over without wasting much toner.

The coefficient of friction $\mu$ between the belt 17*a* and the blade 17*e* tends to increase due to cracks and filming as the number of copies produced (images) increases, as stated above. In detail, the coefficient of friction $\mu$ slightly varies in accordance with instantaneous humidity and temperature, the kind of sheets used, and so forth, causing the belt drive torque to vary.

Figure 17:
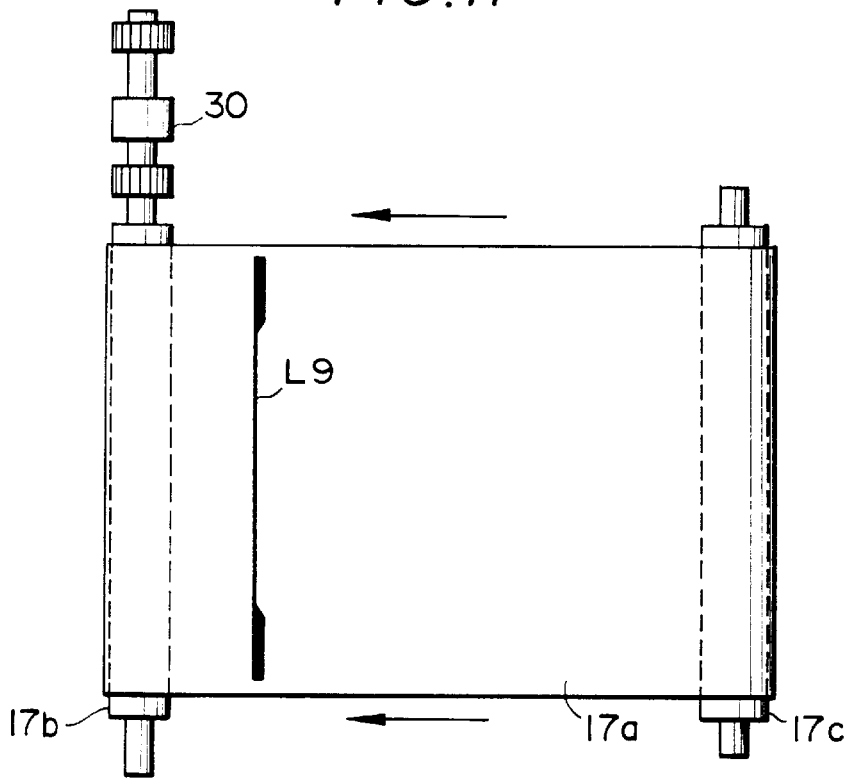
FIG. 17 is a plan view showing an arrangement in which a torque sensor mounted on a drive shaft for driving a drive roller.
Figure 18:
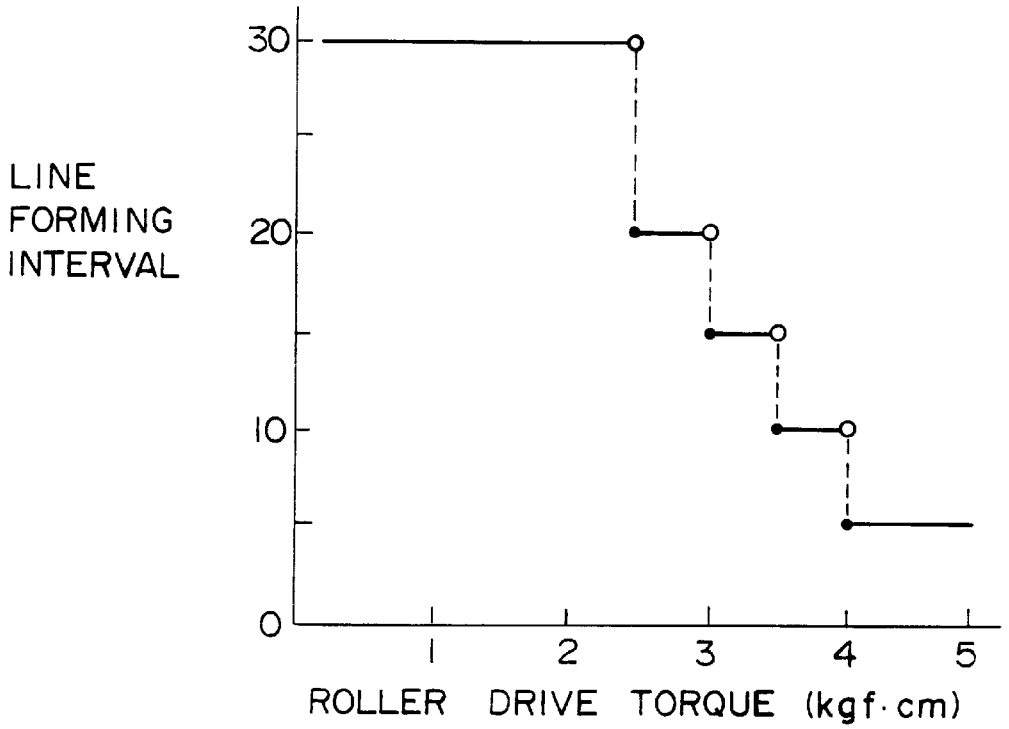
FIG. 18 shows a relation between a torque required to drive the drive roller and the interval between the lines sequentially formed.

In light of the above, as shown in FIG. 17, the illustrative embodiment further includes a torque sensor 30 mounted on the drive roller 17*b*. The output of the torque sensor 30 is sampled once for a preselected number of copies. The amount of toner feed to the blade 17*e* and using the exclusive line is controlled stepwise on the basis of the output of the torque sensor 30. Specifically, as shown in FIG. 18, the line is formed once for thirty copies up to a torque of 2.5 kgf·cm, once for twenty copies up to 3 kgf·cm, once for fifteen copies up to 3.5 kgf·cm, once for ten copies up to 4 kgf·cm, and once for five copies thereafter. In this manner, the amount of toner to be fed to the blade 17*e* is controlled on the basis of the the belt drive torque. This prevents the blade 17*e* from being turned over without wasting much toner.

Figure 19:
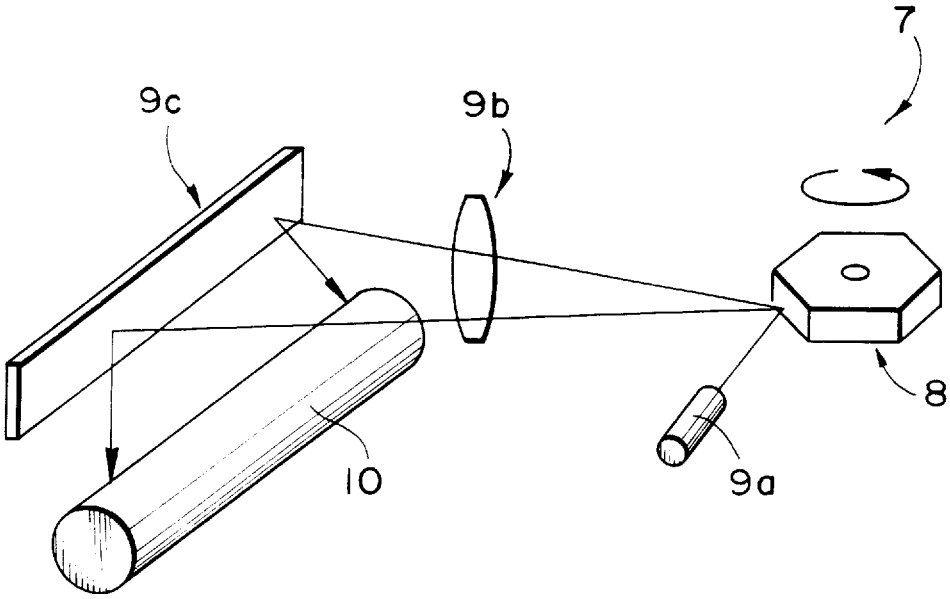
FIG. 19 shows an optical writing device using a laser beam and which is a specific form of line forming means.
Figure 20:
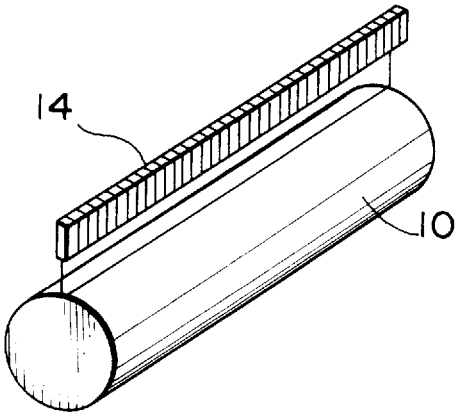
FIG. 20 shows an optical writing device using an LED array and which is another specific form of line forming means.
Figure 21:
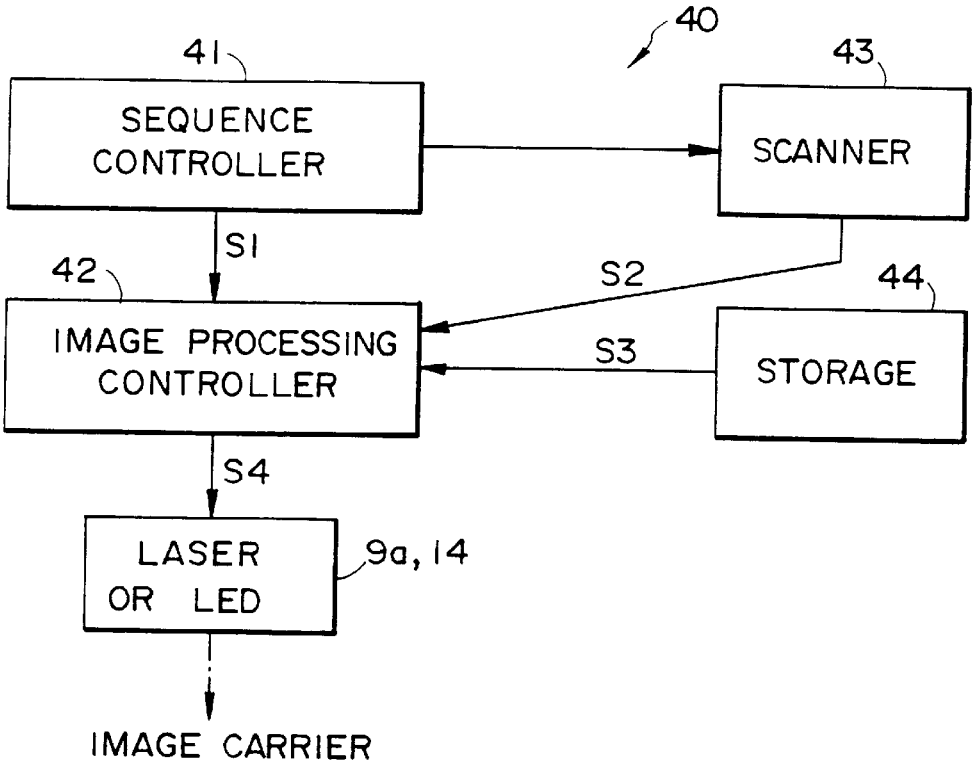
FIG. 21 is a block diagram schematically showing a control system for controlling the line forming means shown in FIG. 19 or 20.

Means for forming any one of the lines L1–L14 will be described hereinafter. Assume the copier shown in FIG. 1 or similar image forming apparatus including the optical writing devices 7 and 14. In this kind of apparatus, only if a pattern representative of any one of the lines L1–L14 is stored in an image data storage, a latent image corresponding to the pattern can be easily formed on the drum 10 between sheets by the writing device 7 or 14. FIG. 19 shows specific means for forming the line and implemented by an optical writing unit using a laser beam. FIG. 20 shows another specific means for forming the line and implemented by an LED array. FIG. 21 shows a control system, generally 40, for controlling such specific means. As shown, the control system 40 includes a sequence controller 41 for outputting a pattern form signal S1. An image processing controller 42 receives image data S2 from the scanner 43 or reads image data S3 representative of the line stored in a storage 44. The controller 42 feeds a laser control signal or LED array control signal S4 to the laser diode 9*a* or the LED array 14. In response, the laser diode 9*a* or the LED array 14 forms a latent image representative of the line on the drum 10.

Specifically, in the writing device 7 shown in FIG. 19, the laser 9*a* emits a laser beam in response to the control signal S4 fed from the image processing controller 42. The laser beam is steered by the polygonal mirror 8 to reach the drum 10 via the lens 9*b*. The laser beam sequentially scans the drum 10 in order to form a latent image thereon. The laser beam forms a latent image on the drum 10 between sheets (outside of the image area) in accordance with the image data S3 stored in the storage 44, as needed. The developing device, not shown, develops the latent image so as to produce a corresponding toner image. The toner image is directly transferred from the drum 10 to the belt, not shown, with the result that the desired line for toner feed is formed on the belt.

In the writing device 14 shown in FIG. 20, the LED array 14 emits light in response to the control signal S4 fed from the image processing controller 42. The light exposes the drum 10 imagewise via a lens array so as to form a latent image thereon. The light forms a latent image on the drum 10 between sheets (outside of the image area) in accordance with the image data S3 stored in the storage 44, as needed. The developing device develops the latent image so as to produce a corresponding toner image. The toner image is directly transferred from the drum 10 to the belt, not shown, with the result that the desired line for toner feed is formed on the belt.

The above specific means for forming the line are applicable to a digital image forming apparatus having the configuration shown in FIG. 1. Hereinafter will be described specific line forming means applicable to an image forming apparatus of the type including an exposing device which directly exposes a photoconductive element imagewise. In this type of apparatus, a pattern representative of a desired line is printed or otherwise provided in the non-image area of a glass platen. Specific line forming means feasible for this type of apparatus will be described with reference to FIGS. 22–24.

Figure 22:
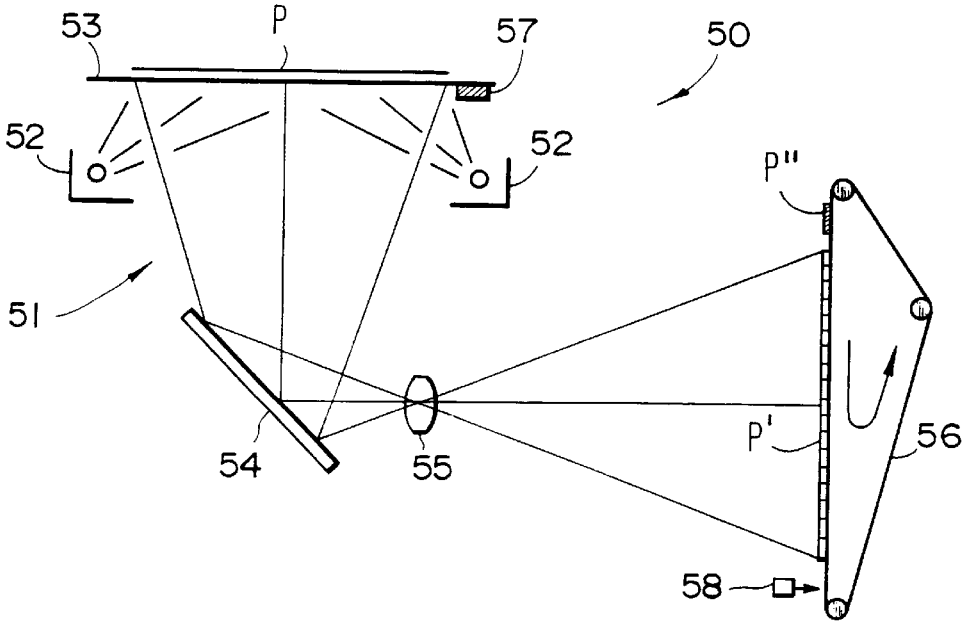
FIGS. 22–24 each shows another specific form of line forming means.

As shown in FIG. 22, an image forming apparatus 50 includes an exposing device 51 having a lamp 52. In response to a signal output from a sequence controller included in a control system, not shown, the lamp 52 turns on and illuminates a document P laid on a glass platen 53. The resulting reflection from the document P is routed through a mirror 54 and a lens 55 to a photoconductive drum 56. As a result, a latent image P' is instantaneously formed on the drum 56. A pattern 57 representative of a desired line is provided on the glass platen 53 outside of an image area such that a latent image P representative of the pattern 57 is formed in the area of the drum 56 either preceding or following its image area. The latent image P" is developed by the developing device and then transferred to the transfer belt.

The latent image P" representative of the pattern is formed the same number of times as the number of times of turn-on of the exposing device 51. An eraser 58 is capable of erasing the latent image P" when the latent image P" is not needed. The exposing area may be enlarged or reduced in scale, if desired.

Figure 23:
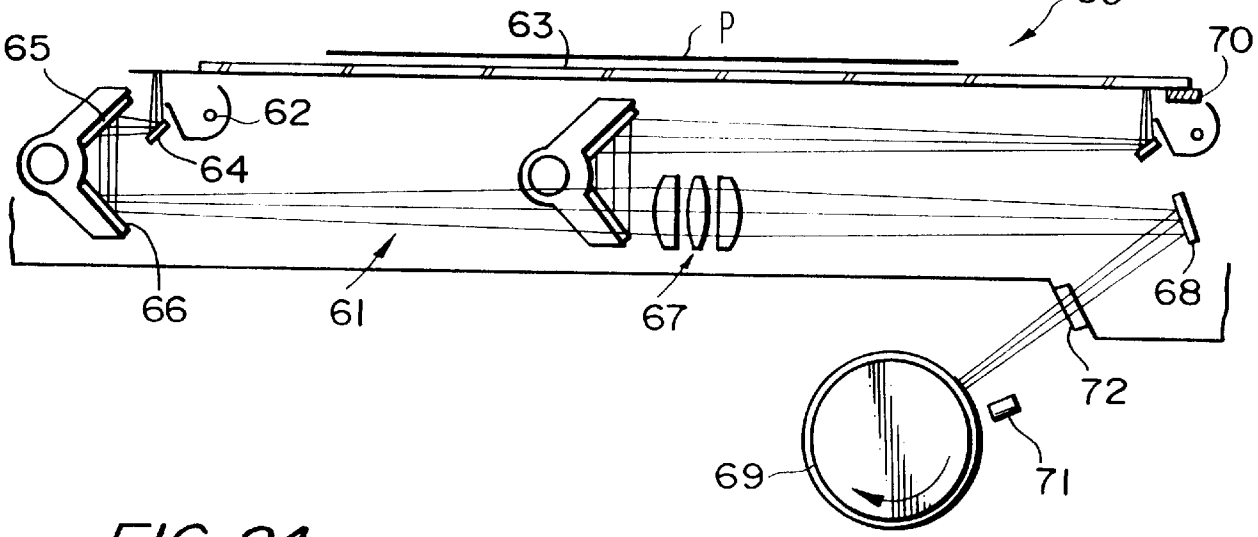

As shown in FIG. 23, an image forming apparatus 60 includes an exposing device 61 having a lamp 62. In response to a signal output from a sequence controller included in a control system, not shown, the lamp 62 turns on and illuminates a document P laid on a glass platen 63. The resulting reflection from the document P is routed through a first mirror 64, a second mirror 65, a third mirror 66, a lens 67 and a fourth mirror, through a light transmitting device 72, to a photoconductive drum 69. As a result, a latent image is formed on the drum 69. A pattern 70 representative of a desired line is provided on the glass platen 63 outside of an image area such that a latent image representative of the pattern 70 is formed in the area of the drum 69 either preceding or following its image area. The latent image is developed by the developing device and then transferred to the belt.

The latent image representative of the pattern is formed the same number of times as the number of times of turn-on of the exposing device 61. An eraser 71 is capable of erasing the latent image when the latent image is not needed. The scanning area may be enlarged or reduced in scale, if desired. In addition, the exposing timing relating to the desired line may be varied, if necessary.

Figure 24:
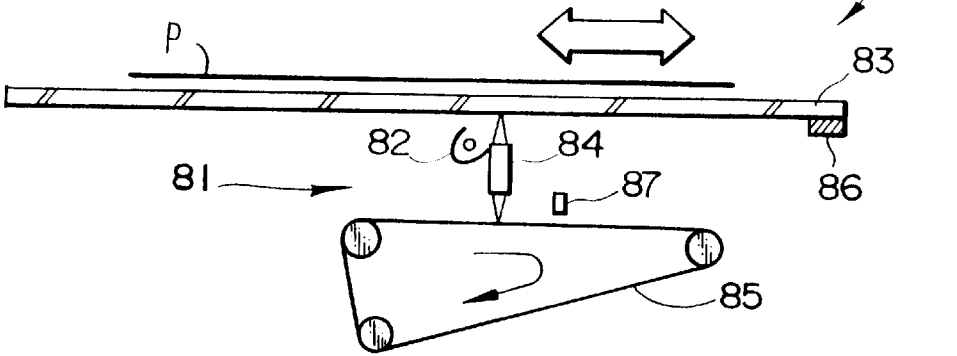

As shown in FIG. 24, an image forming apparatus 80 includes an exposing device 81 having a lamp 82. In response to a signal output from a sequence controller included in a control system, not shown, the lamp 82 turns on and illuminates a document P laid on a glass platen 83. While the glass platen 83 is moved, a reflection from the document P is focused onto a photoconductive element 85 by a lens 84. As a result, a latent image is formed on the drum 85. A pattern 86 representative of a desired line is provided on the glass platen 83 outside of an image area such that a latent image representative of the pattern 86 is formed in the area of the drum 85 either preceding or following its image area. The latent image is developed by the developing device and then transferred to the belt.

The latent image representative of the pattern 86 is formed the same number of times as the number of times of movement of the glass platen 83. An eraser 87 is capable of erasing the latent image when the latent image is not needed. The displacement of the glass platen 83 may may be increased or reduced, if desired. In addition, the exposing timing relating to the desired line may be varied, if necessary.

In summary, it will be seen that the present invention provides an image forming apparatus having various unprecedented advantages, as enumerated below.

(1) A coefficient of friction between a movable belt and a cleaning blade is prevented from increasing due to the absence of toner at the edge of the blade. This prevents the blade from being turned over by the belt.

(2) Toner is fed via an exclusive line in amounts different in the widthwise direction of the belt. Therefore, the amount of toner to be input to the blade can be controlled in the widthwise direction of the belt.

(3) When an image carrier is implemented as a photoconductive belt or an intermediate transfer belt, the movable belt can be selectively brought into or out of contact with the above belt, readily allowing the line to be fed to a cleaning blade assigned to the image carrier or to the movable belt. It follows that even in an image forming apparatus of the type having an image carrier in the form of a belt and a movable belt for image transfer, the edges of cleaning blades respectively associated with the two belts can be prevented from being turned over.

(4) The amount of toner to be input to the cleaning blade can be controlled with respect to the intermediate portion and the opposite ends of the movable belt. This effectively prevents the edge of the blade from being turned over at its opposite ends without wasting much toner.

(5) The amount of toner to be input to the cleaning blade is controlled in accordance with conditions in which the movable belt is used. This also causes a minimum of toner to be wasted.

(6) The amount of toner to be input to the cleaning blade is controlled in accordance with a torque required to drive the movable belt. This also causes a minimum of toner to be wasted.

(7) A pattern representative of a desired line capable of feeding toner in different amounts in the widthwise direction of the movable belt can be easily formed on the belt.

(8) Even when the blade contacts the movable belt perpendicularly to the direction in which the belt runs, the toner is prevented from reaching the blade over the entire width at the same time. The blade can therefore fully remove the toner from the belt even when its pressure acting on the belt is as low as during usual cleaning. This obviates defective cleaning and the scattering of toner when the line for toner feed is formed, while freeing the blade from deterioration.

(9) The interval between the consecutive lines for toner feed (frequency) can be selected in accordance with temperature, humidity, presence/absence of air conditioning, and so forth. This also causes a minimum of toner to be wasted.

Various modifications will become possible for those skilled in the art after receiving the teachings of the present disclosure without departing from the scope thereof. For example, while the illustrative embodiment is implemented as an image forming apparatus including an image transfer/sheet transport device having a belt and a cleaning blade, the present invention is similarly applicable to an image forming apparatus of the type including a photoconductive belt, intermediate transfer belt or similar image carrier in the form of a belt and a cleaning blade. By forming the line for toner feed on such a movable belt, it is also possible to prevent the cleaning blade from being turned over without wasting much toner.

What is claimed is:

1. An image forming apparatus comprising:

an endless movable belt;

a cleaning blade held in contact with said belt for removing toner deposited on a surface of said belt; and toner feeding means for feeding toner to said belt in amounts different in a widthwise direction of said belt, wherein said toner feeding means comprises means for feeding a line of toner formed in the widthwise direction of said belt which is to be cleaned by said cleaning blade, said line of toner comprising toner in amounts different in the widthwise direction of said belt, and wherein said line has a width as measured in the widthwise direction of said belt, greater than a maximum width of a recording medium, but smaller than a width of said cleaning blade.

2. An apparatus as claimed in claim 1, wherein said belt comprises at least one of an image carrier implemented as a belt and a conveyor for conveying the recording medium and implemented as a belt.

3. An apparatus as claimed in claim 1, wherein the line of toner fed by said means for feeding contains a different amount of toner at an intermediate portion than at end portions of said belt.

4. An apparatus as claimed in claim 3, wherein the line of toner fed by said means for feeding contains a greater amount of toner at the opposite end portions than at the intermediate portion.

5. An apparatus as claimed in claim 4, wherein the line of toner is thicker at the opposite end portions than at the intermediate portion.

6. An apparatus as claimed in claim 4, wherein the line of toner has a density higher at the opposite end portions than at the intermediate portion.

7. An apparatus as claimed in claim 4, wherein the line of toner comprises a plurality of lines, a number of said plurality of lines at the opposite end portions being greater than a number of lines at the intermediate portion.

8. An apparatus as claimed in claim 1, further comprising:

an image carrier;

an optical writing device for forming a latent image on said image carrier in accordance with image data; and storing means for storing image data representative of a line pattern for toner feed beforehand, wherein in order to form said line, said optical writing device forms a latent image on said image carrier between recording media by using said image data store in said storing means, and said latent image is developed by toner.

9. An apparatus as claimed in claim 8, wherein said optical writing device uses a laser beam.

10. An apparatus as claimed in claim 8, wherein said optical writing device uses an LED array.

11. An apparatus according to claim 1, wherein:

said toner feeding means comprises means for feeding said line which comprises a plurality of segments of a straight line.

12. An image forming apparatus comprising;

a surface which conveys developed toner images;

a cleaning blade which contacts said surface and is for removing toner from said surface;

a toner feeder which feeds toner to said surface in different amounts in a widthwise direction of said surface, at least some of said toner being other than for forming an image and having a primary purpose of preventing damage due to contact between said surface and said cleaning blade, a humidity sensor which senses humidity, the amount of toner to be fed by said toner feeder being controlled in accordance with humidity sensed by said humidity sensor.

13. An image forming apparatus comprising:

a surface which conveys developed toner images:

a cleaning blade which contacts said surface for removing toner from said surface;

a toner feeder which feeds toner to said surface in different amounts in a widthwise direction of said surface, at least some of said toner being other than for forming an image and having a primary purpose of preventing damage due to contact between said surface and said cleaning blade, wherein the amount of toner fed by said toner feeder increases as a cumulative number of images formed increases.

14. An image forming apparatus comprising:

a surface which conveys developed toner images;

a cleaning blade which contacts said surface for removing toner from said surface;

a toner feeder which feeds toner to said surface in different amounts in a widthwise direction of said surface, at least some of said toner being other than for forming an image and having a primary purpose of preventing damage due to contact between said surface and said cleaning blade, wherein the amount of toner fed by said toner feeder is controlled in accordance with a torque required to drive said surface.

15. An image forming apparatus comprising:

an image carrier on which a toner image is formed;

an endless movable belt for conveying a recording medium and transferring the toner image from said image carrier to the recording medium;

a cleaning blade held in contact with said belt for removing toner deposited on a surface of said belt; and toner feeding means for feeding toner to said belt in amounts different in a widthwise direction of said belt, wherein said toner feeding means comprises means for feeding a line of toner formed in the widthwise direction of said belt which is to be cleaned by said cleaning blade, said toner feeding means comprising means for feeding said line of toner in amounts different in the widthwise direction of said belt, wherein said line has a width, as measured in the widthwise direction of said belt, greater than a maximum width of the recording medium but smaller than a width of said cleaning blade.

16. An apparatus as claimed in claim 15, wherein the line of toner fed by said toner feeding means differs in amount from an intermediate portion to opposite end portions of said belt.

17. An apparatus as claimed in claim 16, wherein the line of toner fed by said toner feeding has a greater amount of toner at the opposite end portions than at the intermediate portion.

18. An apparatus as claimed in claim 17, wherein said line is thicker at the opposite end portions than at the intermediate portion.

19. An apparatus as claimed in claim 17, wherein said line has a density higher at the opposite end portions than at the intermediate portion.

20. An apparatus as claimed in claim 17, wherein said line comprises a greater number of lines at the opposite end portions than at the intermediate portion.

21. An apparatus as claimed in claim 15, further comprising:

a humidity sensor responsive to humidity around said image carrier, the amount of toner fed by said toner feeding means being controlled in accordance with humidity sensed by said humidity sensor.

22. An apparatus as claimed in claim 15, wherein the amount of toner fed by said toner feeding means increases as a cumulative number of images formed increases.

23. An apparatus as claimed in claim 15, wherein the amount of toner fed by said toner feeding means is controlled in accordance with a torque required to drive a drive roller over which said belt is passed.

24. An apparatus as claimed in claim 15, further comprising:

an optical writing device for forming a latent image on said image carrier in accordance with image data; and storing means storing image data representative of said line;

wherein said optical writing device forms a latent image on said image carrier between recording media using said image data stored in said storing means, and said latent image is developed by toner.

25. An apparatus as claimed in claim 24, wherein said optical writing device uses a laser beam.

26. An apparatus as claimed in claim 24, wherein said optical writing device uses an LED array.

27. An image forming apparatus including an image transfer/medium transport device, comprising:

an image carrier on which a toner image is formed;

a movable belt constituting said image transfer/medium transport device and facing said image carrier;

bias applying means facing a rear of said belt;

a cleaning blade for cleaning a front of said belt;

a line of toner formed on said image carrier between recording media; and transferring means for transferring said line from said image carrier to said belt, wherein said line of toner comprises different amounts of toner in a widthwise direction of said belt;

wherein said belt carrying a recording medium thereon is caused to contact said image carrier in order to transfer the toner image from said image carrier to said belt with a high voltage being applied to the rear of said belt by said bias applying means, the recording medium is conveyed toward a fixing section, and said cleaning blade removes toner left on the front of said belt, wherein said line has a width, as measured in the widthwise direction of said belt, greater than a maximum width of the recording medium, but smaller than a width of said cleaning blade.

28. An apparatus as claimed in claim 27, wherein said belt is endless and has a medium resistance.

29. An apparatus as claimed in claim 27, wherein the toner of said line differs in amount from an intermediate portion to opposite end portions of said belt.

30. An apparatus as claimed in claim 29, wherein the toner of said line has a greater amount at the opposite end portions than at the intermediate portion.

31. An apparatus as claimed in claim 30, wherein said line is thicker at the opposite end portions than at the intermediate portion.

32. An apparatus as claimed in claim 30, wherein said line has a density higher at the opposite end portions than at the intermediate portion.

33. An apparatus as claimed in claim 30, wherein said line comprises a greater number of lines at the opposite end portions than at the intermediate portion.

34. An apparatus as claimed in claim 27, wherein said belt is passed over a plurality of rollers, endless, and provided with a medium resistance, said image transfer/medium transport device including a moving mechanism for selectively moving said belt into or out of contact with said image carrier.

35. An apparatus as claimed in claim 34, wherein the toner of said line differs in amount from an intermediate portion to opposite end portions of said belt.

36. An apparatus as claimed in claim 34, further comprising:

a humidity sensor responsive to humidity around said image carrier, the amount of toner of said line being controlled in accordance with humidity sensed by said humidity sensor.

37. An apparatus as claimed in claim 27, further comprising:

a humidity sensor responsive to humidity around said image carrier, the amount of toner of by said line being controlled in accordance with humidity sensed by said humidity sensor.

38. An apparatus as claimed in claim 27, wherein the amount of toner of said line is controlled to increase as a cumulative number of images formed increases.

39. An apparatus as claimed in claim 27, wherein the amount of toner of said line is controlled in accordance with a torque required to drive a drive roller over which said belt is passed.

40. An apparatus as claimed in claim 27, further comprising:

an optical writing device for forming a latent image on said image carrier in accordance with image data; and storing means storing image data representative of a line pattern for toner feed beforehand;

wherein said optical writing device forms a latent image of said line on said image carrier between recording media using said image data stored in said storing means, and said latent image is developed by toner.

41. An apparatus as claimed in claim 40, wherein said optical writing device uses a laser beam.

42. An apparatus as claimed in claim 40, wherein said optical writing device uses an LED array.

43. An apparatus as claimed in claim 27, further comprising:

an exposing device for exposing said image carrier to a document image; and a pattern for forming said line and positioned in a non-image area of a glass platen to be loaded with a document;

wherein a portion of said image carrier between recording media is exposed to said pattern by said exposing device to thereby form a latent image representative of said line, said latent image being developed by toner.

44. An image forming apparatus including an image transfer/medium transport device, comprising:

an image carrier for having a toner image formed thereon;

a movable endless belt having a medium resistance and facing said image carrier;

a bias roller facing a rear of said belt;

a cleaning blade for cleaning a front of said belt;

a line of toner formed on said image carrier between recording media; and transferring means for transferring said line to said belt;

said line comprising a straight line inclined by a predetermined angle relative to said cleaning blade when transferred to said belt;

wherein said belt carrying a recording medium thereon is caused to contact said image carrier in order to transfer the toner image from said image carrier to said belt with a high voltage being applied to said bias roller, then the recording medium is conveyed toward a fixing section, and then said cleaning blade removes toner left on the front of said belt.

45. An image forming apparatus including an image transfer/medium transport device, comprising:

an image carrier for having a toner image formed thereon;

a movable endless belt having a medium resistance and facing said image carrier;

a bias roller facing a rear of said belt;

a cleaning blade for cleaning a front of said belt;

a line of toner formed on said image carrier between recording media; and transferring means for transferring said line to said belt;

said line comprising a non-straight line;

wherein said belt carrying a recording medium thereon is caused to contact said image carrier in order to transfer the toner image from said image carrier to said belt with a high voltage being applied to said bias roller, then the recording medium is conveyed toward a fixing section, and then said cleaning blade removes toner left on the front of said belt.

46. An image forming apparatus including an image transfer/medium transport device, comprising:

an image carrier for having a toner image formed thereon;

a movable endless belt having a medium resistance and facing said image carrier;

a bias roller facing a rear of said belt;

a cleaning blade for cleaning a front of said belt;

a line of toner formed on said image carrier between recording media; and transferring means for transferring said line to said belt;

said line comprising a stripe resembling background contamination;

wherein said belt carrying a recording medium thereon is caused to contact said image carrier in order to transfer the toner image from said image carrier to said belt with a high voltage being applied to said bias applying means, then the recording medium is conveyed toward a fixing section, and then said cleaning blade removes toner left on the front of said belt.

* * * * *